US011723427B1

(12) United States Patent
Kishihara

(10) Patent No.: US 11,723,427 B1
(45) Date of Patent: Aug. 15, 2023

(54) METHOD FOR PRODUCING SUPPORTING GLOVE

(71) Applicant: SHOWA GLOVE CO., Himeji (JP)

(72) Inventor: Hidetoshi Kishihara, Himeji (JP)

(73) Assignee: SHOWA GLOVE CO., Himeji (JP)

( * ) Notice: Subject to any disclaimer, the term of this patent is extended or adjusted under 35 U.S.C. 154(b) by 0 days.

(21) Appl. No.: 17/939,156

(22) Filed: Sep. 7, 2022

(30) Foreign Application Priority Data

Feb. 1, 2022 (JP) ..... 2022-014448

(51) Int. Cl.

| | |
|---|---|
| ***A41D 19/00*** | (2006.01) |
| ***D06N 3/00*** | (2006.01) |
| ***A41H 43/02*** | (2006.01) |
| ***D06N 3/04*** | (2006.01) |
| ***D06N 3/10*** | (2006.01) |
| ***D06N 3/14*** | (2006.01) |
| *D06N 3/18* | (2006.01) |

(52) U.S. Cl.
CPC ..... *A41H 43/02* (2013.01); *A41D 19/00* (2013.01); *D06N 3/0009* (2013.01); *D06N 3/0088* (2013.01); *D06N 3/042* (2013.01); *D06N 3/10* (2013.01); *D06N 3/14* (2013.01); *D06N 3/0034* (2013.01); *D06N 3/0036* (2013.01); *D06N 3/18* (2013.01); *D06N 2205/023* (2013.01); *D06N 2211/103* (2013.01); *D06N 2213/02* (2013.01)

(58) Field of Classification Search
CPC ..... A41D 19/01505; D06N 3/0088
See application file for complete search history.

(56) References Cited

U.S. PATENT DOCUMENTS

| | | | | |
|---|---|---|---|---|
| 6,638,587 | B1 | 10/2003 | Wang et al. | |
| 8,894,896 | B2 * | 11/2014 | Taylor | A41D 31/102 264/45.2 |
| 9,622,526 | B2 | 4/2017 | Nakagawa | |
| 11,229,248 | B2 * | 1/2022 | Honjo | A41D 19/0044 |
| 2003/0022575 | A1 * | 1/2003 | Yoneda | D06N 3/14 442/104 |
| 2013/0219588 | A1 * | 8/2013 | Nakagawa | A41D 19/01558 2/167 |

(Continued)

FOREIGN PATENT DOCUMENTS

| | | | |
|---|---|---|---|
| EP | 1086980 A1 | 3/2001 | |
| EP | 3369332 A1 * | 9/2018 | A41D 19/0006 |

(Continued)

*Primary Examiner* — Cachet I Proctor
(74) *Attorney, Agent, or Firm* — The Webb Law Firm

(57) ABSTRACT

A method for producing a supporting glove includes the steps of applying a specific amount of a first polymer mixed liquid to a knitted glove; drying the first polymer mixed liquid applied to the knitted glove; applying a coagulant solution to the knitted glove after drying; applying a specific amount of a second polymer mixed liquid to the knitted glove after applying the coagulant solution; and drying the second polymer mixed liquid applied to the knitted glove. A first polymer film is formed to cover a yarn knitted into the knitted glove over the entire thickness direction of at least the part of the knitted glove. A second polymer film is formed to continuously cover the first polymer film to form at least a part of an outer surface and not reaching an inner surface of the knitted glove.

3 Claims, 4 Drawing Sheets

(56) References Cited

U.S. PATENT DOCUMENTS

| | | | | |
|---|---|---|---|---|
| 2014/0000006 | A1* | 1/2014 | Perera | D06M 15/564 2/167 |
| 2014/0115751 | A1* | 5/2014 | Saito | A41D 19/0082 2/168 |
| 2015/0143608 | A1* | 5/2015 | Loo | B29D 99/0067 2/169 |
| 2015/0374052 | A1* | 12/2015 | Pimentel de Oliveira | D06N 3/0009 2/161.6 |
| 2016/0073713 | A1* | 3/2016 | Takata | D02G 3/442 2/167 |
| 2016/0150840 | A1* | 6/2016 | Enomoto | C08L 13/00 523/334 |
| 2018/0148892 | A1* | 5/2018 | Sandakelum | D06N 3/0009 |
| 2021/0070907 | A1* | 3/2021 | Hayasaka | D06N 3/0006 |

FOREIGN PATENT DOCUMENTS

| | | | | | |
|---|---|---|---|---|---|
| JP | S62263302 | A | | 11/1987 | |
| JP | 200189912 | A | | 4/2001 | |
| JP | 2013177711 | A | * | 9/2013 | A41D 19/0065 |
| JP | 2013177711 | A | | 9/2013 | |
| JP | 2017106152 | A | | 6/2017 | |
| KR | 20180093763 | A | * | 2/2018 | |

* cited by examiner

METHOD FOR PRODUCING SUPPORTING GLOVE

CROSS-REFERENCE TO RELATED APPLICATION

This application claims priority to Japanese Patent Application No. 2022-014448, filed Feb. 1, 2022, the disclosure of which is hereby incorporated by reference in its entirety.

BACKGROUND OF THE INVENTION

Field of the Invention

The present invention relates to a method for producing a supporting glove.

Description of Related Art

Conventionally known gloves for household and work use are supporting gloves each formed of a knitted glove having a surface on which a film of a polymer such as a rubber or a resin (hereinafter referred to as polymer film) is formed (see, for example, JP 2001-089912 A). As disclosed in JP 2001-089912 A, each of such supporting gloves is mainly produced according to the procedure as follows:

(1) Immerse a knitted glove in a coagulant solution (for example, a methanol solution including 20 mass % of calcium nitrate as a salt coagulant);

(2) Immerse the knitted glove that has been immersed in the coagulant solution in a polymer suspension such as a rubber latex or a resin emulsion; and (3) Subject the knitted glove that has been immersed in the polymer suspension to drying treatment, to thereby form the polymer film on the surface of the knitted glove.

SUMMARY OF THE INVENTION

Technical Problem

When, as described above, the knitted glove is immersed in the polymer suspension followed by the drying treatment to thereby form the polymer film, the following problems occur.

First, if the knitted glove is sufficiently immersed in the polymer suspension to have the polymer film hardly peeled off from the knitted glove, the obtained supporting glove is to have the polymer film formed further to an inner surface of the supporting glove. When the polymer film is thus formed further to the inner surface of supporting glove, a hand of a wearer could be caught on the inner surface of the supporting glove when being placed into the supporting glove. Further, there could be the case where the hand of the wearer in the supporting glove is stuck to the inner surface of the supporting glove. The wearer feels uncomfortable when the hand of the wearer is caught on or stuck to the inner surface at the time of wearing the supporting glove, which is therefore not preferable.

In terms of suppressing the wearer's discomfort at the time of wearing the supporting glove, it is conceivable to prevent the polymer suspension from permeating to the inner surface of the knitted glove. The supporting glove thus obtained can suppress the wearer's discomfort at the time of wearing. However, since the polymer film is not formed to the inner surface of the knitted glove, the polymer film can be easily peeled off from the knitted glove during the use of such a supporting glove. Thus, there is a trade-off relationship between suppressing the wearer's discomfort at the time of wearing the supporting glove and suppressing the polymer film from being easily peeled off from the knitted glove.

However, no sufficient consideration seems to have been given on dissolving this trade-off relationship in the supporting glove.

In view of the above problems, it is an object of the present invention to provide a supporting glove capable of both suppressing a wearer's discomfort at the time of wearing and suppressing a polymer film from being easily peeled off from a knitted glove.

Solution to Problem

A method for producing a supporting glove according to the present invention includes: applying a first polymer mixed liquid including a first liquid and a first polymer, the first polymer mixed liquid including 0.2 mass % or more and 4.0 mass % or less of the first polymer, to at least a part of a knitted glove formed by knitting a yarn having a fineness of 33 dtex or more and 180 dtex or less; drying the first polymer mixed liquid applied to the knitted glove; applying a coagulant solution to the knitted glove after drying the first polymer mixed liquid; applying a second polymer mixed liquid including a second liquid and a second polymer, the second polymer mixed liquid including 20 mass % or more and 65 mass % or less of the second polymer, to at least a part of an area of the knitted glove after applying the coagulant solution, the area having the first polymer mixed liquid applied thereto; and drying the second polymer mixed liquid applied to the knitted glove, in which applying the first polymer mixed liquid and drying the first polymer mixed liquid are carried out to form a first polymer film so as to cover the yarn knitted into the knitted glove over the entire thickness direction of at least the part of the knitted glove, and applying the coagulant solution, applying the second polymer mixed liquid, and drying the second polymer mixed liquid are carried out to form a second polymer film so as to form at least a part of an outer surface of the knitted glove in a state of being worn, and carried out to form the second polymer film so as to continuously cover the first polymer film from the outer surface toward but not reaching an inner surface of the knitted glove in the state of being worn.

DESCRIPTION OF THE INVENTION (Supporting Glove)

A description will be hereinafter given on a supporting glove according to one embodiment of the present invention with reference to the drawings.

Figure 1A:
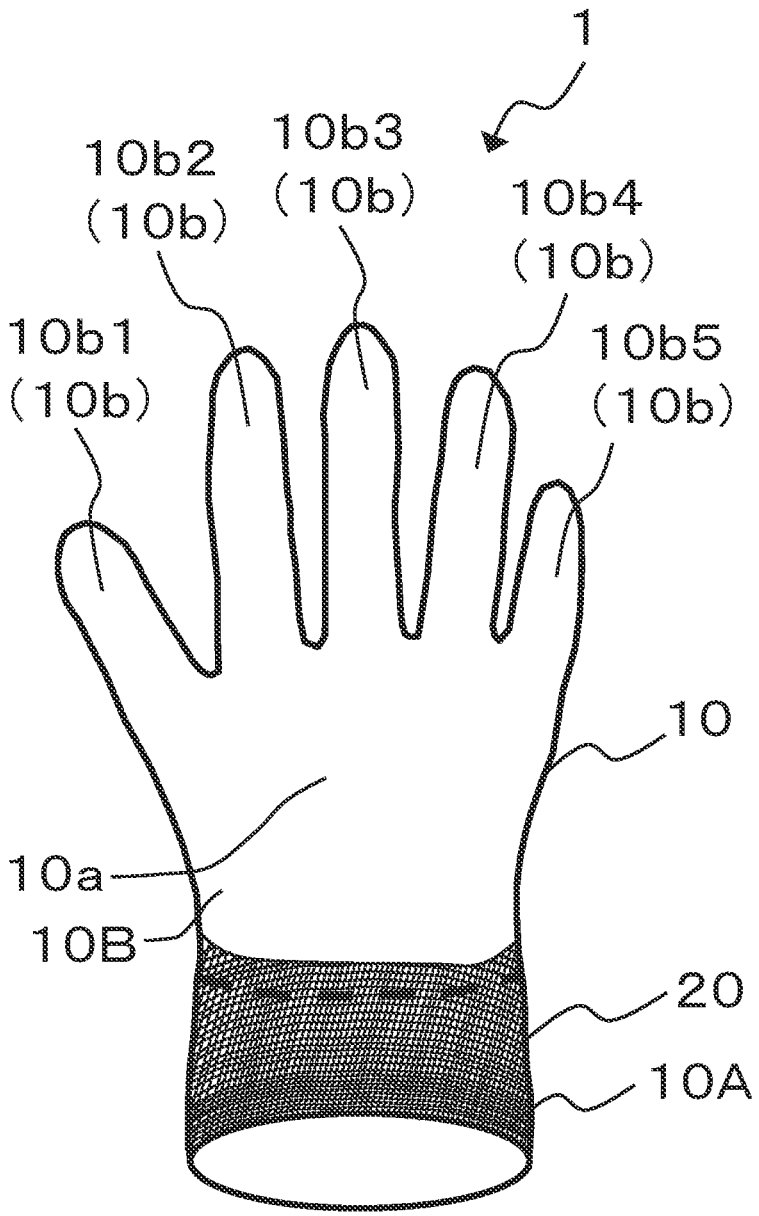
FIG. 1A is a view of the overall configuration of a supporting glove according to one embodiment of the present invention as viewed from its palm side.
Figure 1B:
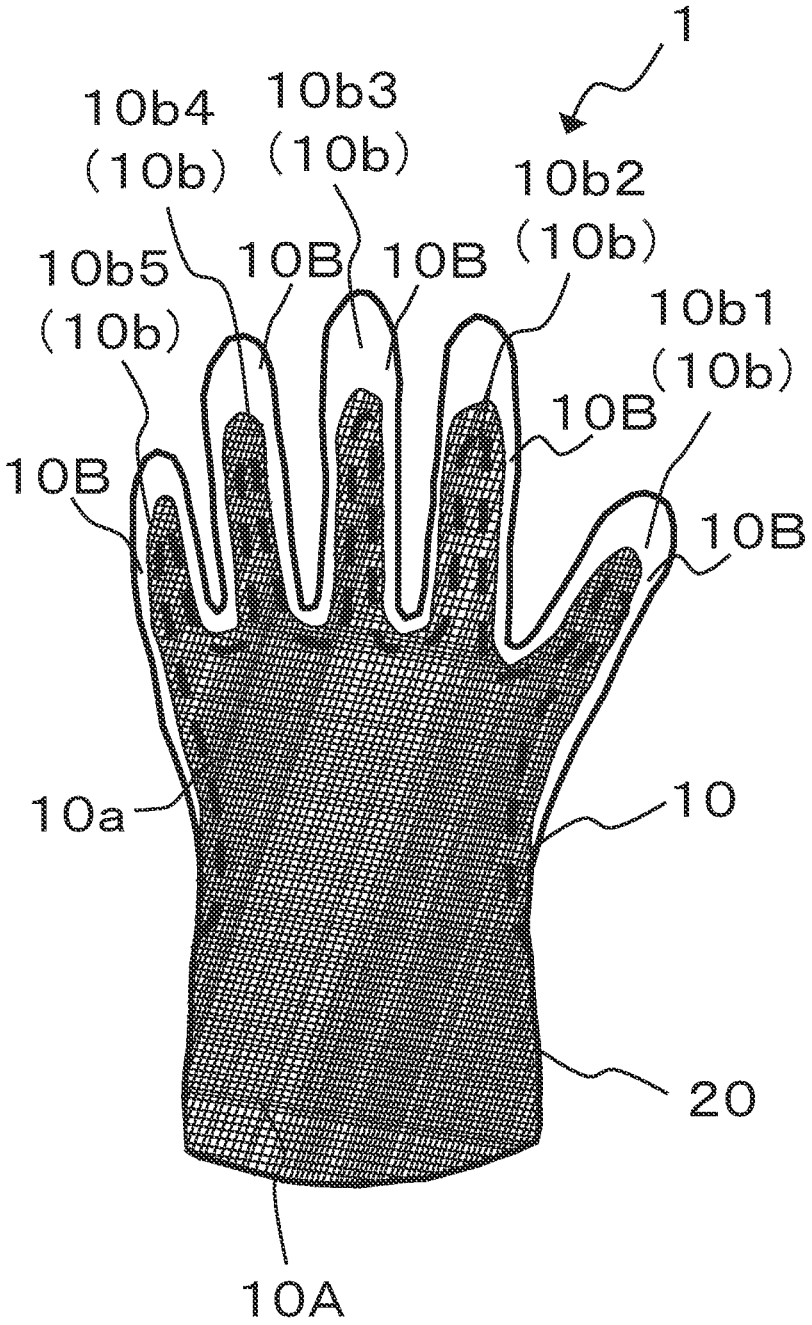
FIG. 1B is a view of the overall configuration of the supporting glove according to one embodiment of the present invention as viewed from its back side.

As shown in FIG. 1A and FIG. 1B, a supporting glove 1 according to this embodiment includes a glove body 10 configured to cover a hand of a wearer, and a cuff 20 connected to the glove body 10 and configured to cover a wrist and a part of a forearm of the wearer.

The glove body 10 includes a body bag 10*a* formed into a bag shape to cover the back and the palm of the hand of the wearer, and finger bags 10*b* each extending from the body bag 10*a* to cover each finger of the wearer. The finger bags 10*b* include a first finger part 10*b*1, a second finger part 10*b*2, a third finger part 10*b*3, a fourth finger part 10*b*4, and a fifth finger part 10*b*5 configured to respectively cover a first finger (a thumb), a second finger (an index finger), a third finger (a middle finger), a fourth finger (a ring finger), and a fifth finger (a little finger), of the wearer. The first finger part 10*b*1 to the fifth finger part 10*b*5 have a tubular shape with their fingertip parts closed.

The supporting glove 1 according to this embodiment includes a knitted glove 10A, and a polymer film 10B covering at least a part of an outer surface of the knitted glove 10A. A part of the polymer film 10B permeates into the knitted glove 10A. On the palm side of the supporting glove 1 according to this embodiment, as shown in FIG. 1A, the polymer film 10B is formed to cover the entire outer surface of the body bag 10*a* and a part of an outer surface of a part of the cuff 20, and to cover the entire outer surfaces of the first finger part 10*b*1 to the fifth finger part 10*b*5. On the back side of the supporting glove 1 according to this embodiment, as shown in FIG. 1B, the polymer film 10B is formed to have its end edge laid along side edges of the first finger part 10*b*1 to the fifth finger part 10*b*5 and a side edge of the body bag 10*a*, and to have its end edge laid along each portion between each two adjacent finger parts, and is formed to cover portions of the respective finger parts closer to the fingertip side from positions of the finger parts corresponding to the first joints of the fingers of the hand of the wearer. In each of the finger parts, the polymer film 10B is formed to draw an arc from the side edges toward the fingertip of each of the finger parts. That is, on the back side of the supporting glove 1 according to this embodiment, the polymer film 10B is formed to cover a part of the body bag 10*a* and a part of each of the first finger part 10*b*1 to the fifth finger part 10*b*5. In FIG. 1A and FIG. 1B, a thick broken line is provided to define an area in which a first polymer film 10B1 to be described later is formed.

Examples of a yarn to be knitted into the knitted glove 10A include a spun yarn, a filament yarn, and a mixed yarn. Each of these yarns can be a single yarn or a double-ply yarn. Examples of fibers forming these yarns include cotton fibers, polyester fibers, nylon fibers, polyethylene fibers, polypropylene fibers, acrylic fibers, aramid fibers, poly p-phenylenebenzoxazole (PBO) fibers, glass fibers, metal fibers, and fibers including inorganic particles dispersed therein. The polyester fibers include crystalline polyester fibers. The polyethylene fibers include ultra-high molecular weight polyethylene fibers, and include highly stretched polyethylene fibers as well. Examples of the aramid fibers include para-aramid fibers and meta-aramid fibers. These fibers can be used individually to form a yarn, or a plurality of these fibers can be used in combination to form a yarn.

Examples of the spun yarn include various known spun yarns such as a ring spun yarn, an open end spun yarn, and a bundle spun yarn. The spun yarn can be obtained by individually spinning each of the above various kinds of fibers, or can be obtained by spinning a plurality of the above various kinds of fibers. Examples of the filament yarn include a non-crimped yarn and a crimped yarn. Examples of the mixed yarn include a twisted yarn obtained by twisting a plurality of strands of yarn formed of different kinds of fibers, and a covering yarn (covered yarn) having a core-sheath structure.

In terms of easily knitting the knitted glove 10A and achieving an improved fitting performance of the supporting glove 1, a filament crimped yarn is preferably used as the yarn, and a crimped yarn formed of nylon fibers or polyester fibers is preferably used as the filament crimped yarn. In terms of achieving an improved cutting resistance of the knitted glove 10A, it is preferable that the covering yarn be used as the yarn, and that the covering yarn include a core for which a spandex yarn is used, and a sheath for which a cut resistant yarn made of ultra-high molecular weight polyethylene fibers, highly stretched polyethylene fibers, para-amid fibers, fibers including inorganic particles dispersed therein, or crystalline polyester fibers is used, or that the covering yarn include a core for which a yarn made of stainless-steel fibers or glass fibers is used, and a sheath for which a yarn made of nylon fibers, polyester fibers, ultra-high molecular weight polyethylene fibers, or highly stretched polyethylene fibers is used.

The above yarns can be used in combination with various elastic yarns such as a natural rubber yarn or a spandex yarn. Use of the above various elastic yarns imparts high stretchability to the knitted glove 10A.

The knitted glove 10A can be knitted with the aforementioned yarns individually, or can be knitted with a plurality of kinds thereof in combination, and the yarn used for knitting the knitted glove 10A has a fineness of 33 dtex or more. The yarn having a fineness of 33 dtex or more gives sufficient strength to the knitted glove 10A, and can increase the durability of the knitted glove 10A. The fineness of the yarn used for knitting the knitted glove 10A is preferably 44 dtex or more, more preferably 55 dtex or more. The yarn used for knitting the knitted glove 10A has a fineness of 180 dtex or less. The yarn having a fineness of 180 dtex or less allows the knitted glove 10A to have a sufficiently small thickness, and can thus achieve the supporting glove 1 having its inner surface excellent in texture and having an increased workability when worn by the wearer. The fineness of the yarn used for knitting the knitted glove 10A is preferably 167 dtex or less, more preferably 154 dtex or less, further preferably 144 dtex or less. Further, the fineness of the yarn used for knitting the knitted glove 10A being 33 dtex or more and 180 dtex or less allows the first polymer film to be formed so as to more sufficiently cover the yarn (more specifically, so as to more sufficiently cover the surfaces of the fibers forming the yarn). The fineness of the yarn used for knitting the knitted glove 10A refers to the total fineness of the yarn used for knitting each course of the knitted glove 10A. For example, in the case where a plurality of yarns are used for knitting one course of the knitted glove 10A, the total fineness refers to the value obtained by summing the fineness of the plurality of yarns. In the case where the knitted glove 10A is formed by inlay knitting in which a rubber-based or other type of weft is inlaid (inserted) into the base knitted fabric, the weft used for the inlay knitting shall not be included in obtaining the fineness (total fineness) of the above yarn(s).

The knitted glove 10A can be produced by various known methods, and for example, can be produced by knitting a yarn using a glove knitting machine. Examples of the glove knitting machine include models N-SFG, N-SFGi, and SWG manufactured by Shima Seiki Mfg., Ltd. It is preferable that the glove knitting machine have the number of gauges of 18 or more. The number of gauges being 18 or more allows a yarn of 180 dtex or less to be used, and thus enables a knitted glove having an extremely small thickness to be obtained. It is more preferable that the glove knitting machine have the number of gauges of 21 or more. Further, it is preferable that the glove knitting machine have the number of gauges of 26 or less. The number of gauges being 26 or less allows the obtained knitted glove to have high strength. Examples of the method for producing the knitted glove 10A other than the method using the glove knitting machine include a method in which a knitted fabric is cut to obtain a pair of pieces of the knitted fabric having a shape of a glove, and thereafter the pair of pieces of the knitted fabric having a shape of a glove are sewn to each other to obtain a knitted glove. However, since the above method including sewing generates additional costs for, for example, sewing costs, the method for producing the knitted glove 10A is preferably the method using the glove knitting machine, and is more preferably the method in which the knitted glove is seamlessly formed using the glove knitting machine. The knitted glove 10A can be knitted by various known methods, and examples thereof include knitting by plain knitting. The knitted glove 10A can be produced by knitting a plurality of strands of yarns arranged in parallel, or can be produced by knitting a plurality of strands of yarns by plate knitting. In the case where the knitted glove 10A is formed to have, for example, excellent cutting resistance or excellent hygroscopicity and quick-drying performance, it is preferable that the knitted glove 10A be knitted by plate knitting.

The knitted glove 10A has a thickness of preferably 0.15 mm or more, more preferably 0.25 mm or more, further preferably 0.35 mm or more. The knitted glove 10A has a thickness of preferably 0.80 mm or less, more preferably 0.70 mm or less, further preferably 0.60 mm or less. The thickness of the knitted glove 10A is measured according to JIS L 1086 and JIS L 1096 using a thickness meter (for example, PG-15 manufactured by TECLOCK; the area in which the probe is in abutting contact with an object to be measured is 1 $cm^2$; measurement force of 240 $gf/cm^2$) before the polymer film 10B is formed.

The polymer film 10B includes the first polymer film 10B1 formed to cover the yarn knitted into the knitted glove 10A. The first polymer film 10B1 is formed in at least a part of the knitted glove 10A to cover the yarn (more specifically, the surfaces of the fibers forming the yarn) knitted into the knitted glove 10A over the entire thickness direction thereof. On the palm side of the supporting glove 1 according to this embodiment, the first polymer film 10B1 is formed in the entire outer surface of the body bag 10*a* and a part of the outer surface of the cuff 20 to cover the yarn (more specifically, the surfaces of the fibers forming the yarn) knitted into the knitted glove 10A over the entire thickness direction thereof, and is formed in the entire outer surfaces of the first finger part 10*b*1 to the fifth finger part 10*b*5 to cover the yarn (more specifically, the surfaces of the fibers forming the yarn) knitted into the knitted glove 10A over the entire thickness direction thereof. On the back side of the supporting glove 1 according to this embodiment, the first polymer film 10B1 is formed along the side edges of the first finger part 10*b*1 to the fifth finger part 10*b*5 and the side edge of the body bag 10*a* and along each portion between each two adjacent finger parts, to cover the yarn (more specifically, the surfaces of the fibers forming the yarn) knitted into the knitted glove 10A over the entire thickness direction thereof, and is formed in portions of the respective finger parts closer to the fingertip side from positions of the finger parts corresponding to the second joints of the fingers of the hand of the wearer, to cover the yarn (more specifically, the surfaces of the fibers forming the yarn) knitted into the knitted glove 10A over the entire thickness direction thereof. The polymer film 10B includes a second polymer film 10B2 formed to serve as at least a part of the outer surface of the knitted glove 10A in the state of being worn, and formed to continuously cover the first polymer film 10B1 from the outer surface toward but not reaching the inner surface of the knitted glove 10A in the state of being worn. In the supporting glove 1 according to this embodiment, the second polymer film 10B2 is formed at a different position from the position at which the first polymer film 10B1 is formed on the palm side and the back side thereof. In terms of facilitating production, an area in which the first polymer film 10B1 is formed is preferably larger than the area in which the second polymer film 10B2 is formed.

Figure 2A:
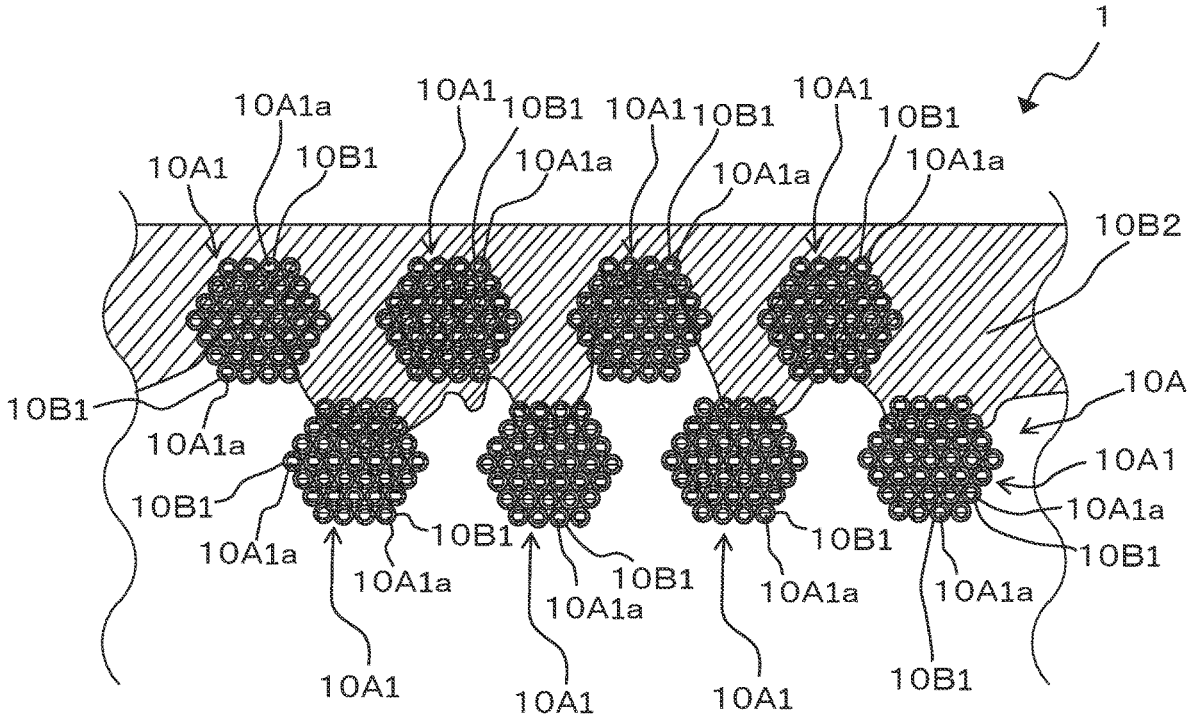
FIG. 2A is a cross-sectional view of a portion (i.e., central portion of a palm) of the supporting glove according to one embodiment of the present invention on which a first polymer film and a second polymer film are formed.
Figure 2B:
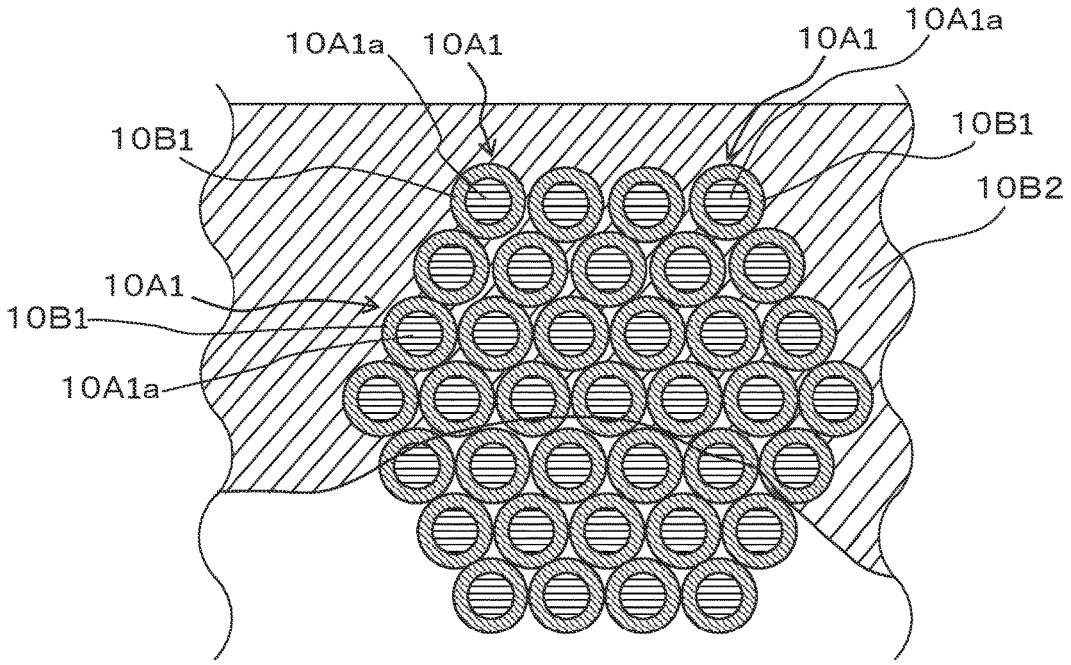
FIG. 2B is an enlarged cross-sectional view of a part of FIG. 2A.

A more specific description will be hereinafter given on the configuration of the polymer film 10B with reference to FIG. 2A and FIG. 2B. FIG. 2A shows a cross section of a palm part while FIG. 2B is an enlarged view of a part of FIG. 2A.

The knitted glove 10A is formed by knitting a yarn 10A1 made of fibers 10A1*a*, and thus has voids between adjacent strands of the yarn 10A1, as shown in the cross-sectional view in FIG. 2A. As described above, the first polymer film 10B1 is formed to cover the yarn 10A1 knitted into the knitted glove 10A (more specifically, to cover the surfaces of the fibers 10A1*a* forming the yarn 10A1). Thus, in the state where the first polymer film 10B is formed on the knitted glove 10A, the voids are formed through the knitted glove 10A from its outer surface to its inner surface. As shown in FIG. 2A, the second polymer film 10B2 is formed to serve as at least a part of the outer surface, and to continuously cover the first polymer film 10B1 from the outer surface toward but not reaching the inner surface of the knitted glove 10A. That is, as shown in FIG. 2A, the second polymer film 10B2 is formed to a depth not reaching the inner surface of the knitted glove 10A. In the supporting glove 1 according to this embodiment, as shown in FIG. 2A, the second polymer film 10B2 is formed to be filled between adjacent strands of the yarn 10A1 of the knitted glove 10A from the outer surface of the knitted glove 10A. That is, the second polymer film 10B2 is formed as a dense film. As shown in FIG. 2B, it is preferable that the fibers 10A1*a* forming the yarn 10A1 knitted into the knitted glove 10A include gaps formed at least partially between the adjacent fibers 10A1*a* in the state where the first polymer film 10B1 covers the surfaces of the fibers 10A1*a*. The configuration that the gaps are formed at least partially between the adjacent fibers 10A1*a* enables the second polymer film 10B2 to be formed to fill the gaps, and thus more securely achieves the adhesiveness of the second polymer film 10B2 to the yarn 10A1 via the first polymer film 10B1. In terms of easily forming the gaps at least partially between the adjacent fibers 10A1*a*, it is preferable that a filament yarn be used as the yarn 10A1. In the knitted glove 10A, the outer surface refers to a surface facing outside when the knitted glove 10A is worn while the inner surface refers to a surface facing inside (i.e., a surface in contact with the hand of the wearer) when the knitted glove 10A is worn. As described above, in the supporting glove 1 according to this embodiment, the polymer film 10B includes two kinds of polymer films (i.e., the first polymer film 10B1 and the second polymer film 10B2) formed differently from each other.

Various known polymers can be used as a polymer for forming the first polymer film 10B1. Hereinafter, the polymer can be referred to as polymer particles. Examples of the polymer include natural rubber (NR), an acrylonitrile-butadiene copolymer (NBR), polychloroprene, polyisoprene, a (meth)acrylate ester copolymer, and polyurethane (PU). Particles of the natural rubber (NR), particles of the acrylonitrile-butadiene copolymer (NBR), particles of the polychloroprene, particles of the polyisoprene, and particles of the (meth)acrylate ester copolymer can be their carboxy-modified products. These kinds of polymers can be used individually, or a plurality of kinds of polymers can be used in combination. It is preferable that the first polymer film 10B1 be formed of at least one polymer selected from the group consisting of the natural rubber (NR), the acrylonitrile-butadiene copolymer (NBR), and the polyurethane (PU). Since the first polymer film 10B1 is formed of the aforementioned polymer, the inner surface of the obtained supporting glove in the state of being worn tends to have an increased gripping force. The first polymer film 10B1 can include various compounding agents. Examples of the various compounding agents include: vulcanizing agents such as sulfur; vulcanization accelerators such as zinc dimethyldithiocarbamate or zinc oxide; crosslinking agents including functional groups such as an epoxide group, a carbodiimide group, or an isocyanate group; plasticizers or softeners such as mineral oils or phthalate esters; antioxidants or aging inhibitors such as 2,6-t-butyl methylphenol; thickeners such as acrylic polymers or polysaccharides; blowing agents such as azodicarbonamide; foaming agents or foam stabilizers such as sodium stearate; anti-tacking agents such as paraffin wax; and fillers or pigments such as carbon black, calcium carbonate, or fine powder silica. The same polymers as above can be used as a polymer for forming the second polymer film 10B2, and the second polymer film 10B2 can also include the above various compounding agents similar to the first polymer film 10B1.

A conventional supporting glove is formed such that a knitted glove is impregnated with a coagulant solution having a relatively high concentration to form a polymer film with a salt coagulation method using a polymer mixed liquid having a relatively high concentration. In this method, the coagulant solution or the polymer mixed liquid cannot sufficiently permeate into a yarn (i.e., gaps between fibers forming the yarn; in other words, gaps in a fiber bundle formed by assembling a plurality of fibers). For the conventional supporting glove, therefore, it is difficult to form a polymer film so as to sufficiently permeate into the yarn. In the supporting glove 1 according to this embodiment, on the other hand, the first polymer film 10B1 is formed so that a polymer for forming the first polymer film 10B1 covers the surfaces of the fibers 10A1*a* forming the yarn 10A1. Thus, the polymer for forming the first polymer film 10B1 intrudes (permeates) into gaps between the fibers 10A1*a*. This configuration allows the polymer having intruded (permeated) into the gaps between the fibers 10A1*a* to exhibit a favorable anchor effect, and thus enables the first polymer film 10B1 to sufficiently adhere to the yarn forming the knitted glove 10A. The second polymer film 10B2 covers the first polymer film 10B1 as described above. The first polymer film 10B1 and the second polymer film 10B2 are both formed of polymers, which have relatively high affinity for each other. As described above, therefore, the configuration that the first polymer film 10B1 is caused to sufficiently adhere to the yarn forming the knitted glove 10A secures the sufficient adhesiveness of the second polymer film 10B2 to the yarn via the first polymer film 10B1. In terms of increasing the adhesiveness of the second polymer film 10B2 to the first polymer film 10B1, it is preferable that the polymer for forming the first polymer film 10B1 and the polymer for forming the second polymer film 10B2 be of the same kind. In the case where the polymer for forming the first polymer film 10B1 and the polymer for forming the second polymer film 10B2 are of different kinds, it is preferable that the relationship of SP1<SP2<SP3 or the relationship of SP3<SP2<SP1 be satisfied, where the solubility parameters (SP values) of the fibers forming a yarn, a first polymer, and a second polymer are SP1, SP2, and SP3, respectively. Satisfying such a relationship can further increase the adhesiveness of the second polymer film 10B2 to the yarn via the first polymer film 10B1.

The thickness of the second polymer film 10B2 is preferably 0.15 mm or more. The thickness being 0.15 mm or more allows the supporting glove 1 to have sufficient durability. The thickness of the second polymer film 10B2 is more preferably 0.25 mm or more. The thickness of the second polymer film 10B2 is preferably 1.0 mm or less. The thickness being 1.0 mm or less allows the supporting glove 1 to have sufficient flexibility and to be easily fit to the hand. The supporting glove 1 thus obtained gives excellent touching feeling to the fingertips of the wearer, and has an increased workability. The thickness of the second polymer film 10B2 is more preferably 0.8 mm or less, further preferably 0.6 mm or less. The thickness of the second polymer film 10B2 can be obtained by observing its cross section at a magnification of 100 times using a digital microscope (model VHX-6000, manufactured by KEYENCE CORPORATION), and then arithmetically averaging the values measured at 10 places at intervals of 500 μm. The cross-sectional observation using the digital microscope is carried out by observing a cross section of the center of the palm of the glove. The center of the palm of the glove herein means an area in the palm near the point at which a straight line drawn in a longitudinal direction of the glove (i.e., a direction in which the third finger part extends) from the crotch between the third finger part and the fourth finger part intersects with a straight line drawn in a lateral direction of the glove (i.e., a direction orthogonal to the longitudinal direction) from the crotch between the first finger part and the second finger part.

The second polymer film 10B2 can be formed as a porous film by being subjected to foaming treatment, or can be formed as a non-porous film without being subjected to foaming treatment, but is preferably formed as a non-porous film. The non-porous film herein means a film having no visible voids when the cross-section thereof is observed at a magnification of 100 times using a digital microscope (model VHX-6000). However, any void resulting from unexpected foam or bubbles shall be ignored.

The surface of the second polymer film 10B2 can be subjected to anti-slipping treatment. This anti-slipping treatment applied to the surface of the second polymer film 10B2 can further increase the anti-slipping performance of the supporting glove 1. A description will be given later on a method for subjecting the surface of the second polymer 10B2 to anti-slipping treatment.

The cuff 20 is formed in a tubular shape. In the supporting glove 1 according to this embodiment, the cuff 20 is formed of a knitted fabric obtained by knitting a yarn. In the supporting glove 1 according to this embodiment, the cuff 20 is integrally and continuously formed with the glove body 10. However, the configuration can be such that the cuff 20 is knitted separately from the glove body 10, and is connected to the glove body 10.

It is preferable that the inner surface of the supporting glove 1 according to this embodiment in the state of being worn have a dynamic friction coefficient of more than 0.27. The dynamic friction coefficient is more preferably 0.30 or more, further preferably 0.40 or more. The dynamic friction coefficient falling within the numerical range as aforementioned allows the inner surface of the obtained supporting glove in the state of being worn to have an increased gripping force. The dynamic friction coefficient is preferably 2.30 or less, more preferably 1.50 or less, further preferably 1.00 or less. The dynamic friction coefficient falling within the numeral range as aforementioned allows the obtained supporting glove to have good wearing and removing performance. The dynamic friction coefficient can be measured by a method to be described later in Examples. The dynamic friction coefficient refers to an average dynamic friction coefficient to be described later in Examples.

It is preferable that the supporting glove 1 according to this embodiment have a peel strength of more than 20 N when the second polymer film 10B2 is peeled off from the knitted glove 10A. This configuration allows the supporting glove 1 according to this embodiment to have sufficient peel resistance. The peel strength can be measured by a method to be described later in Examples. Further, it is preferable that the supporting glove 1 according to this embodiment have a tear strength measured according to EN388 of more than 20 N. This configuration allows the supporting glove 1 according to this embodiment to be excellent in tear resistance.

(Method for Producing Supporting Glove)

Next, a description will be given on a method for producing the supporting glove according to this embodiment.

Figure 3:
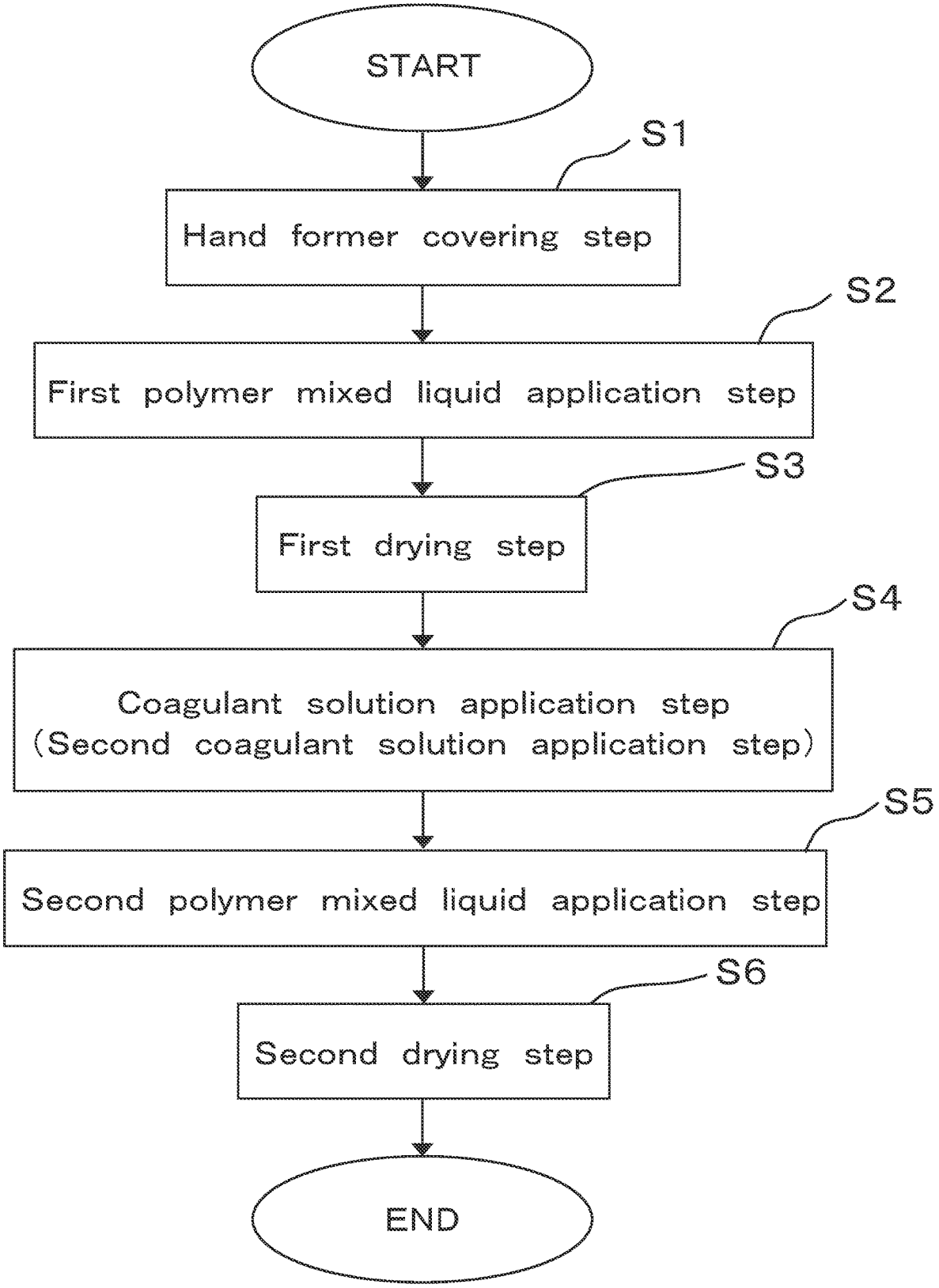
FIG. 3 is a flowchart explaining a method for producing the supporting glove according to one embodiment of the present invention.

A method for producing the supporting glove according to this embodiment includes: a first polymer mixed liquid application step of applying a first polymer mixed liquid, which includes a first liquid and a first polymer and includes 0.2 mass % or more and 4.0 mass % or less of the first polymer, to at least a part of a knitted glove knitted with a yarn having a fineness of 33 dtex or more and 180 dtex or less; a first drying step of drying the knitted glove after the first polymer mixed liquid application step; a coagulant solution application step of applying a coagulant solution to the knitted glove after the first drying step; a second polymer mixed liquid application step of applying a second polymer mixed liquid, which includes a second liquid and a second polymer and includes 20 mass % or more and 65 mass % or less of the second polymer, to at least a part of an area of the knitted glove after the coagulant solution application step, the area being an area to which the first polymer mixed liquid has been applied; and a second drying step of drying the knitted glove after the second polymer mixed liquid application step. As has already been described, the fineness of the yarn refers to the total fineness of the yarn(s) used for knitting each course of the knitted glove 10A. In the case where the knitted glove 10A is formed by inlay knitting in which a rubber-based or other type of weft is inlaid (inserted) into the base knitted fabric, the weft used for the inlay knitting shall not be included in obtaining the fineness (total fineness) of the above yarn(s). In the method for producing the supporting glove according to this embodiment, the first polymer mixed liquid application step and the first drying step are carried out to form the first polymer film in at least a part of the knitted glove so as to cover the yarn knitted into the knitted glove (more specifically, cover the surfaces of the fibers forming the yarn) over the entire thickness direction thereof. In the method for producing the supporting glove according to this embodiment, the coagulant solution application step, the second polymer mixed liquid application step, and the second drying step are carried out to form the second polymer film so as to form at least a part of the outer surface of the knitted glove in the state of being worn, and to form the second polymer film so as to continuously cover the first polymer film from the outer surface toward but not reaching the inner surface of the knitted glove in the state of being worn. A description will be hereinafter given on the method for producing the supporting glove according to this embodiment by taking, for example, the case where a step of covering a hand former for processing with the knitted glove (i.e., a hand former covering step) is carried out followed by the first polymer mixed liquid application step and subsequent steps (see FIG. 3).

(Hand Former Covering Step: S1)

In this step, a hand former for processing is covered with a knitted glove knitted with a yarn having a fineness of 33 dtex or more and 180 dtex or less. The hand former for processing can be a hand former for immersion processing. A similar knitted glove to that described above can be used as the knitted glove. As the hand former for processing, various known hand formers made of, for example, a ceramic or a metal can be used.

(First Polymer Mixed Liquid Application Step: S2)

In this step, the first polymer mixed liquid in which the first polymer is mixed in the first liquid is applied to at least a part of the knitted glove after the hand former covering step S1. More specifically, the first polymer mixed liquid is applied to at least a part of the knitted glove after the hand former covering step S1 so as to cover the yarn knitted into the knitted glove (more specifically, to cover the surfaces of the fibers forming the yarn) over the entire thickness direction thereof. On the palm side of the knitted glove in this embodiment, the first polymer mixed liquid is applied to the entire outer surface of the body bag and the outer surface of a part of the cuff so as to cover the yarn knitted into the knitted glove (more specifically, cover the surfaces of the fibers forming the yarn) over the entire thickness direction thereof, and is applied to the entire outer surfaces of the first finger part to the fifth finger part so as to cover the yarn knitted into the knitted glove over the entire thickness direction thereof. On the back side of the knitted glove, the first polymer mixed liquid is applied along the side edges of the first finger part to the fifth finger part and the side edge of the body bag, and along each portion between two adjacent finger parts so as to cover the yarn knitted into the knitted glove (more specifically, cover the surfaces of the fibers forming the yarn) over the entire thickness direction thereof, and is applied to portions of the respective finger parts closer to the fingertip side from positions of the finger parts corresponding to the second joints of the fingers of the hand of the wearer so as to cover the yarn knitted into the knitted glove (more specifically, to cover the surfaces of the fibers forming the yarn) over the entire thickness direction thereof. The application as above can be carried out by immersing the knitted glove in the first polymer mixed liquid from its palm side at an angle of 5 to 20° between the liquid surface of the first polymer mixed liquid and the direction in which the third finger part of the knitted glove extends.

The first polymer mixed liquid can be a suspension liquid in which the first polymer particles are suspended in the first liquid, or can be a solution in which the first polymer particles are dissolved (completely dissolved) in the first liquid. Since the first polymer mixed liquid includes the first polymer at a relatively low concentration of 0.2 mass % or more and 4.0 mass % or less, the first polymer mixed liquid can permeate in at least a part of the knitted glove over the entire thickness direction thereof so as to thinly cover the surface of each yarn forming the knitted yarn (more specifically, the surfaces of the fibers forming each yarn). The first polymer mixed liquid including 0.2 mass % or more of the first polymer allows the inner surface (i.e., surface in contact with the hand of the wearer) of the knitted glove in the obtained supporting glove to have an increased gripping force or an increased smoothness depending on the intended purposes. This configuration can increase the workability with the obtained supporting glove, and/or can increase the wearing and removing performance of the supporting glove. The first polymer mixed liquid including 0.2 mass % or more of the first polymer can suppress the second polymer film from being easily peeled off, and further can suppress tearing resistance from being degraded. The first polymer mixed liquid preferably includes 0.3 mass % or more of the first polymer. The first polymer mixed liquid including 4.0 mass % or less of the first polymer allows the obtained supporting glove to suppress the wearer's discomfort resulting from an excessively high gripping force of the inner surface of the knitted glove that causes the hand of the wearer to be firmly caught on the inner surface of the knitted glove when the wearer wears or removes the supporting glove. The first polymer mixed liquid preferably includes 3.0 mass % or less of the first polymer.

Since the first polymer mixed liquid is formed to include the first polymer at a concentration of 0.2 mass % or more and 4.0 mass % or less, and the second polymer mixed liquid, which will be described later, is formed to include the second polymer at a concentration of 20 mass % or more and 65 mass % or less, the permeation of the first polymer mixed liquid and the second polymer mixed liquid into the knitted glove can be easily controlled in the first polymer mixed liquid application step S2 and the second polymer mixed liquid application step S5, respectively, even in the case where the knitted glove 10A has an extremely small thickness of 0.15 mm or more and 0.80 mm or less. This configuration allows the obtained supporting glove to suppress the wearer's discomfort when he or she wears the supporting glove, and to suppress the polymer film from being peeled off from the knitted glove.

Examples of the first liquid include water and an organic solvent, and examples of the organic solvent include methyl ethyl ketone, n-hexane, xylene, N,N'-dimethylformamide. When the first liquid is water, the first polymer mixed liquid is a latex in which the first polymer particles are suspended in water. Examples of the first polymer particles include natural rubber (NR) particles, acrylonitrile-butadiene copolymer (NBR) particles, polychloroprene particles, polyisoprene particles, (meth)acrylate ester copolymer particles, and polyurethane (PU) particles. The natural rubber (NR) particles, the acrylonitrile-butadiene copolymer (NBR) particles, the polychloroprene particles, the polyisoprene particles, and the (meth)acrylate ester copolymer particles can be their carboxy-modified products.

The first polymer mixed liquid can include various compounding agents. Examples of the various compounding agents include: vulcanizing agents such as sulfur; vulcanization accelerators such as zinc dimethyldithiocarbamate or zinc oxide; crosslinking agents including functional groups such as an epoxide group, an oxazoline group, a carbodiimide group, or an isocyanate group; plasticizers or softeners such as mineral oils or phthalate esters; antioxidants or aging inhibitors such as 2,6-t-butyl-4-methylphenol; thickeners such as acrylic polymers or polysaccharides; blowing agents such as azodicarbonamide; foaming agents or foam stabilizers such as sodium stearate; anti-tacking agents such as paraffin wax; and fillers or pigments such as carbon black, calcium carbonate, or fine powder silica.

Other examples of the first polymer mixed liquid include a mixed liquid formed by obtaining a solid content of a polymer from a polymer mixed liquid once prepared, and then completely dissolving the solid content of the polymer in an organic solvent, and a mixed liquid formed by suspending the solid content of the polymer in an organic solvent while the solid content is partially dissolved therein. Examples of a method for obtaining the solid content of the polymer include a method for obtaining the solid content of the polymer by allowing the polymer mixed liquid to dry, and a method for obtaining the solid content of the polymer by adding a coagulant such as a salt coagulant or an acid coagulant to the polymer mixed liquid. Examples of a combination of the solid content of the polymer and the organic solvent include the combination of a solid content of the nitrile butadiene rubber as the solid content of the polymer and methyl ethyl ketone as the organic solvent, and the combination of a solid content of natural rubber as the solid content of the polymer and hexane or heptane as the organic solvent. Use of the first polymer mixed liquid thus prepared allows the first polymer film to be more uniformly formed on the yarn knitted into the knitted glove. It is preferable that the solid content of the first polymer be added to the organic solvent in a content of 0.2 mass % or more. The content being 0.2 mass % or more allows the inner surface (i.e., surface in contact with the hand of the wearer) of the knitted glove in the obtained supporting glove to have an increased gripping force or an increased smoothness. This increased smoothness can increase the wearing and removing performance of the obtained supporting glove. Further, the content being 0.2 mass % or more can suppress the second polymer film from being easily peeled off, and can moreover suppress tearing resistance from being degraded. It is preferable that the solid content of the first polymer be added to the organic solvent in a content of 4.0 mass % or less. The content being 4.0 mass % or less allows the obtained supporting glove to suppress the wearer's discomfort resulting from an excessively high gripping force of the inner surface of the knitted glove that causes the hand of the wearer to be firmly caught on the inner surface of the knitted glove when the wearer wears or removes the supporting glove.

When the first liquid is water and the first polymer mixed liquid is a latex as described above, it is preferable that a first coagulant solution application step S1' of applying a coagulant solution to the knitted glove covering the hand former for processing be carried out before the first polymer mixed liquid application step S2. The coagulant solution used for carrying out the first coagulant solution application step S1' is hereinafter referred to as a first coagulant solution. The first coagulant solution application step S1' can be carried out in the same manner as in the first polymer mixed liquid application step S2. As the first coagulant solution, various known coagulant solutions can be used. For example, alcohols such as methanol can be used as the first coagulant solution, and methanol solutions or aqueous solutions including a multivalent metal salt or an organic acid can be used as the first coagulant solution. As the first coagulant solution, a solution including the multivalent metal salt is preferably used. The solution including the multivalent metal salt allows the first polymer film to be formed in a desired portion of the knitted glove. The coagulant solution is used to cause the polymer dispersed in the polymer mixed liquid to be aggregated in the polymer mixed liquid.

Examples of the multivalent metal salt include barium chloride, calcium chloride, magnesium chloride, zinc chloride, aluminum chloride, barium nitrate, calcium nitrate, zinc nitrate, barium acetate, calcium acetate, zinc acetate, calcium sulfate, magnesium sulfate, and aluminum sulfate. These multivalent metal salts can be used individually, or a plurality of these can be used in combination. When the first coagulant solution includes the multivalent metal salt, the content of the multivalent metal salt is preferably 0.01 mass % or more. The content of the multivalent metal salt being 0.01 mass % or more allows the first polymer film to be efficiently formed over the entire yarn forming the knitted glove in the portion of the knitted glove on which the first polymer mixed liquid has been applied. The content of the multivalent metal salt is more preferably 0.03 mass % or more, further preferably 0.05 mass % or more. The content of the multivalent metal salt is preferably 1 mass % or less, more preferably 0.5 mass % or less.

Examples of the organic acid include acetic acid and citric acid. When the first coagulant solution includes the organic acid, the content of the organic acid is preferably 0.01 mass % or more and 5 mass % or less. The organic acid can be used in combination with the multivalent metal salt.

When the first coagulant solution is applied to the knitted glove covering the hand former for processing, the temperature of the knitted glove is preferably 40° C. or more and 75° C. or less in terms of allowing the first coagulant solution to sufficiently permeate into the knitted glove. The temperature of the knitted glove can be adjusted by being heated in an atmosphere at a specific temperature. For example, when the temperature of the knitted glove is set at 70° C., the knitted glove is heated in an atmosphere at a temperature of 70° C. When the first coagulant solution is applied to the knitted glove by immersing the knitted glove in the first coagulant solution, the solvent in the first coagulant solution is caused to volatilize at a temperature of preferably 25° C. or more and 70° C. or less after the knitted glove covering the hand former for processing is pulled out of the first coagulant solution. The duration of time for which the solvent is caused to volatilize is preferably 10 seconds or more. In terms of productivity, the duration of time for which the solvent is caused to volatilize is preferably 600 seconds or less.

(First Drying Step: S3)

In the first drying step S3, the first solution is caused to volatilize by drying the first liquid from the first polymer mixed liquid that has been applied to the knitted glove. The first drying step S3 can be carried out using various known ovens. When the first solution is water, the drying temperature is preferably 50° C. or more and 100° C. or less. When the first solution is water, the drying time is preferably 5 minutes or more and 30 minutes or less. When the first solution is an organic solvent, the drying temperature can be appropriately set in consideration of the boiling point of the organic solvent. When the first solution is an organic solvent, the drying time is preferably 30 seconds or more and 10 minutes or less. The first drying step S3 is carried out as described above to thereby form the first polymer film. The first polymer film is formed in the entire outer surface of the body bag and a part of the outer surface of the cuff to cover the yarn knitted into the knitted glove (more specifically, to cover the surfaces of the fibers forming the yarn) over the entire thickness direction thereof. As has been already described, therefore, in the state where the first polymer film is formed, the voids are formed through the knitted glove from its outer surface to its inner surface.

(Coagulant Solution Application Step: S4)

In a coagulant solution application step S4, a coagulant solution for coagulating the second polymer included in the second polymer mixed liquid to be described later is caused to adhere to the first polymer film of the knitted glove after the first drying step S3. The coagulant solution application step S4 is hereinafter referred to as second coagulant solution application step S4 in order to be differentiated from the first coagulant solution application step S1'. Further, the coagulant solution used in this step is referred to as second coagulant solution in order to be differentiated from the first coagulant solution. The second coagulant solution application step S4 can be carried out in the same manner as in the first polymer mixed liquid application step S2. The second coagulant solution application step S4 is carried out for the purpose of coagulating (hardening) the second polymer in the second polymer mixed liquid into a desired state in the glove in the second polymer mixed liquid application step S5 to be described later. More specifically, the second coagulant solution application step S4 is carried out for the purpose of coagulating the second polymer before the second polymer mixed liquid reaches the inner surface of the knitted glove. When the knitted glove 10A has an extremely small thickness of 0.15 mm or more and 0.80 mm or less, it is difficult to form a uniform polymer film for an anti-slipping purpose on the surface of the yarn knitted into the knitted glove 10A, unless the first polymer film is formed to cover the yarn. This is because when the coagulant solution is applied to the knitted glove 10A having an extremely small thickness to form a polymer film, it is difficult to keep the coagulant solution uniformly held on the yarn knitted into the knitted glove 10A. In contrast, when the first polymer film is formed to cover the yarn knitted into the knitted glove 10A followed by applying the second coagulant solution thereto and forming the second polymer film, the filling effect of the first polymer film in addition to the effect of the coagulant solution (e.g., multivalent metal salt and/or organic acid to be described later) enable the second polymer to be uniformly applied to cover the first polymer film. In addition, in the method for producing the supporting glove according to this embodiment, the second coagulant solution includes the multivalent metal salt and/or the organic acid at an appropriate concentration as will be described later, and can thus be appropriately applied to the first polymer film. That is, the second coagulant solution can be appropriately retained on the first polymer film. Thus, the second polymer mixed liquid can be uniformly applied to the first polymer film to which the second coagulant solution has been applied.

As the second coagulant solution, various known coagulant solutions can be used. For example, methanol solutions or aqueous solutions including a multivalent metal salt or an organic acid can be used. As the second coagulant solution, a solution including the multivalent metal salt is preferably used. The second coagulant solution including the multivalent metal salt allows the second polymer mixed liquid, which will be described later, to be suppressed from excessively permeating into the knitted glove.

Examples of the multivalent metal salt include barium chloride, calcium chloride, magnesium chloride, zinc chloride, aluminum chloride, barium nitrate, calcium nitrate, zinc nitrate, barium acetate, calcium acetate, zinc acetate, calcium sulfate, magnesium sulfate, and aluminum sulfate. These multivalent metal salts can be used individually, or a plurality of these can be used in combination. When the second coagulant solution includes the multivalent metal salt, the content of the multivalent metal salt is preferably 0.1 mass % or more, more preferably 0.3 mass % or more, further preferably 0.5 mass % or more. In terms of suppressing the fibers of the yarn knitted into the knitted glove from being degraded, the content of the multivalent metal salt is preferably 1.6 mass % or less, more preferably 1.4 mass % or less, further preferably 1.2 mass % or less, yet further preferably 1.0 mass % or less.

Examples of the organic acid include acetic acid and citric acid. When the second coagulant solution includes the organic acid, the content of the organic acid is preferably 1 mass % or more and 10 mass % or less. The organic acid can be used in combination with the multivalent metal salt.

The temperature of the hand former for forming when the second coagulant solution is applied to the knitted glove after the first drying step S3 is 40° C. or more and 75° C. or less, in terms of sufficiently applying the second coagulant solution to the inside of the knitted glove. When the second coagulant solution is applied to the knitted glove by immersing the knitted glove in the second coagulant solution, the duration of time for which the solvent in the second coagulant solution applied to the knitted glove is caused to volatilize is preferably 10 seconds or more and 600 seconds or less. Herein, the second coagulant solution applied to the knitted glove refers to the second coagulant solution that has been applied to the knitted glove after the knitted glove following the first drying step S3 is pulled out of the second coagulant solution. The volatilization time set to fall within the above range can control the second polymer mixed liquid so as not to excessively intrude inside the knitted glove in the second polymer mixed liquid application step S5 to be described later. This configuration can suppress the second polymer film from being formed on the inner surface side of the obtained supporting glove. The supporting glove consequently obtained can suppress the wearer's discomfort resulting from an excessively high gripping force of the inner surface of the knitted glove that causes the hand of the wearer to be firmly caught on the inner surface of the knitted glove when the wearer wears or removes the supporting glove, or resulting from a partial permeation of the second polymer film into the inner surface that irritates the fingers of the wearer. The obtained supporting glove can further suppress the second polymer film from being peeled off therefrom. In terms also of productivity, the duration of time for which the solvent is caused to volatilize is preferably 600 seconds or less. Further, when the solvent is an organic solvent such as methanol, the duration of time for which the solvent is caused to volatilize is preferably 10 seconds or more and 180 seconds or less, and when the solvent is water, the duration of time for which the solvent is caused to volatilize is preferably 30 seconds or more and 600 seconds or less.

(Second Polymer Mixed Liquid Application Step: S5)

In this step, the second polymer mixed liquid including the second liquid and the second polymer is applied to at least a part of an area of the knitted glove after the second coagulant solution application step S4 (coagulant solution application step S4) to which the first polymer mixed liquid has been applied. In the second polymer mixed liquid application step S5, the second polymer mixed liquid can be applied in the same manner as in the first polymer mixed liquid application step S2. The second polymer mixed liquid can be applied to the area in which the second coagulant solution has been applied in the second coagulant solution application step S4. That is, the second polymer mixed liquid can be applied to cover the second coagulant solution that has been applied to the first polymer film, from the outer surface toward but not reaching the inner surface of the knitted glove. With this configuration, the second polymer film formed of the second polymer included in the second polymer mixed liquid covers the first polymer film in a portion of the knitted glove to which the second polymer mixed liquid has been applied.

The second polymer mixed liquid includes the second polymer at a concentration of 20 mass % or more and 65 mass % or less. The second polymer mixed liquid including the second polymer at such a relatively high concentration enables the obtained supporting glove to have the second polymer film sufficiently forming the outer surface thereof. Further, the second polymer mixed liquid including 20 mass % or more of the second polymer allows the second polymer film to have a sufficient thickness, and thus allows the obtained supporting glove to have high durability. The second polymer mixed liquid including the second polymer at such a concentration as above suppresses excessive shrinkage of the second polymer film in the course of being formed in the second drying step S6 to be described later, and can thus suppress the formed second polymer film from cracking. The second polymer is mixed to the second liquid in a content of preferably 25 mass % or more, more preferably 30 mass % or more. Further, the second polymer mixed liquid including 65 mass % or less of the second polymer allows the coagulation speed by the coagulant to be easily controlled, and thus allows the second polymer mixed liquid to easily permeate uniformly into the knitted glove after the first drying step S3. This allows this step to be efficiently carried out.

In the method for producing the supporting glove according to this embodiment, the second liquid is water. Thus, the second polymer mixed liquid is a latex in which the second polymer particles are suspended in water. As the second polymer particles, the same polymer particles as the first polymer particles can be used. The second polymer mixed liquid can include the same various compounding agents as the first polymer mixed liquid.

Further, the second polymer mixed liquid can be subjected to machine foaming treatment. It is preferable that the machine foaming treatment be carried out so that the air content in the second polymer mixed liquid is 10 volume % or more and 50 volume % or less. The second polymer mixed liquid subjected to the machine foaming treatment as described above allows the second polymer film formed through the second drying step S6, which will be described later, to be porous and thus excellent in flexibility. When the second polymer mixed liquid is not subjected to the machine foaming treatment, the second polymer film obtained is non-porous.

(Second Drying Step: S6)

In the second drying step S6, the second liquid is caused to volatilize from the second polymer mixed liquid that has been applied to the knitted glove. The second drying step S6 can be carried out using various known ovens. The drying temperature of the second liquid is preferably 50° C. or more and 100° C. or less. The drying time of the second liquid is preferably 5 minutes or more and 60 minutes or less. When the second polymer particles need to be fused to each other, the second drying step S6 is carried out at a temperature and for a duration of time needed for the fusion. As described above, the second polymer film is formed through the second drying step S6. The second polymer film forms at least a part of the outer surface, and is formed to continuously cover the first polymer film 10B1 from the outer surface toward but not reaching the inner surface of the knitted glove. That is, the second polymer film is formed to a depth not reaching the inner surface of the knitted glove. The second polymer film is formed to fill the voids between adjacent strands of the yarn in the knitted glove. When the first polymer film and the second polymer film include a crosslinking agent or a vulcanizing agent, further heating can be carried out in the second drying step S6 to accelerate a crosslinking reaction in the first polymer film and the second polymer film. The heating temperature for accelerating the crosslinking reaction can be, for example, 90° C. or more and 150° C. or less, and the heating time can be, for example, 10 minutes or more and 60 minutes or less.

As described above, the supporting glove according to this embodiment can be obtained.

In the method for producing the supporting glove according to this embodiment, the surface of the second polymer film can be subjected to anti-slipping treatment by any one of steps (1) to (7) below:

(1) Mixing anti-slipping particles (e.g., anti-slipping particles having an average particle size of 10 μm or more) in the second polymer mixed liquid in the second polymer mixed liquid application step S5 to form unevenness with the anti-slipping particles on the surface of the second polymer film;

(2) After the second drying step S6, applying a third polymer mixed liquid in which anti-slipping particles and a third polymer are mixed in a third liquid to the surface of the second polymer film, followed by allowing the third polymer mixed liquid to dry to form a third polymer film having unevenness;

(3) After the second polymer mixed liquid application step S5 and before the second drying step S6, slightly drying the surface to which the second polymer mixed liquid has been applied to obtain a half-dried second polymer film, followed by causing a solvent having such characteristics as to swell the half-dried second polymer film to come into contact with the surface of the half-dried second polymer film to form unevenness on the surface of the second polymer film;

(4) After the second polymer mixed liquid application step S5 and before the second drying step S6, causing deliquescent particles to come into contact with the surface of an undried second polymer film to subject the undried second polymer film to salt coagulation in a state where the deliquescent particles are bit into the undried second polymer film, followed by, for example, rinsing off the deliquescent particles with water for removing them from the surface to form unevenness on the surface of the undried second polymer film, and further carrying out the second drying step S6 to thereby form the second polymer film having an uneven surface;

(5) After the second polymer mixed liquid application step S5 and before the second drying step S6, causing deliquescent particles to come into contact with the surface of an undried second polymer film and allowing the undried second polymer film to slightly dry in a state where the deliquescent particles are bit into the undried second polymer film to obtain a half-dried second polymer film, followed by, for example, rinsing off the deliquescent particles with water for removing them from the surface to form unevenness on the surface of the half-dried second polymer film, and further carrying out the second drying step S6 to thereby form the second polymer film having an uneven surface;

(6) After the second polymer mixed liquid application step S5 and before the second drying step S6, immersing the knitted glove to which the second polymer mixed liquid has been applied in a coagulant solution to form a coagulated second polymer film, followed by pressing the coagulated second polymer film into an uneven surface shape and carrying out the second drying step S6 to thereby form the second polymer film having an uneven surface; or (7) Pressing the surface of the second polymer film into an uneven shape during the second drying step S6 to thereby form the second polymer film having an uneven surface, or pressing the surface of the second polymer film into an uneven shape while being heated after the second drying step S6 to thereby form the second polymer film having an uneven surface.

The matters disclosed herein include the following:

(1)

A method for producing a supporting glove, the method including the steps of:

applying a first polymer mixed liquid including a first liquid and a first polymer, the first polymer mixed liquid including 0.2 mass % or more and 4.0 mass % or less of the first polymer, to at least a part of a knitted glove formed by knitting a yarn having a fineness of 33 dtex or more and 180 dtex or less;

drying the first polymer mixed liquid applied to the knitted glove;

applying a coagulant solution to the knitted glove after drying the first polymer mixed liquid;

applying a second polymer mixed liquid including a second liquid and a second polymer, the second polymer mixed liquid including 20 mass % or more and 65 mass % or less of the second polymer, to at least a part of an area of the knitted glove after applying the coagulant solution, the area having the first polymer mixed liquid applied thereto; and drying the second polymer mixed liquid applied to the knitted glove, in which applying the first polymer mixed liquid and drying the first polymer mixed liquid are carried out to form a first polymer film so as to cover the yarn knitted into the knitted glove over the entire thickness direction of at least the part of the knitted glove, and applying the coagulant solution, applying the second polymer mixed liquid, and drying the second polymer mixed liquid are carried out to form a second polymer film so as to form at least a part of an outer surface of the knitted glove in a state of being worn, and carried out to form the second polymer film so as to continuously cover the first polymer film from the outer surface toward but not reaching an inner surface of the knitted glove in the state of being worn.

According to such a configuration, the first polymer mixed liquid including the first polymer at a relatively low concentration of 0.2 mass % or more and 4.0 mass % or less is applied to at least a part of the knitted glove formed by knitting the yarn having a fineness within a specific numerical range in the first polymer mixed liquid application step, and thus the first polymer mixed liquid can adhere to the surface of each yarn knitted into the knitted glove so as to thinly cover the surface of the yarn over the entire thickness direction of at least a part of the knitted glove. Thus, carrying out the first polymer mixed liquid application step and the first drying step forms the first polymer film so as to thinly cover the surface of each yarn knitted into the knitted glove over the entire thickness direction of at least a part of the knitted glove. Both the first polymer film and the second polymer film are formed of polymers, and have a relatively high affinity for each other. Thus, carrying out the coagulant solution application step, the second polymer mixed liquid application step, and the second drying step to form the second polymer film as aforementioned can form the second polymer film sufficiently adhering to the first polymer film. Further, carrying out these steps can form the second polymer film so as not to be exposed through the inner surface of the supporting glove in the state of being worn. Since the second polymer mixed liquid includes the second polymer at a relatively high concentration of 20 mass % or more and 65 mass % or less, the second polymer film can form a relatively thick outer surface of the supporting glove in the state of being worn. The above configuration can suppress the wearer's discomfort or unnecessary irritation resulting from the case where the hand of the wearer is caught on the inner surface of the obtained supporting glove when the wearer wears the supporting glove, or resulting from the case where the hand of the wearer in the supporting glove is stuck to the inner surface of the supporting glove. Further, the second polymer film can be formed so as to be hardly peeled off from the knitted glove. That is, the obtained supporting glove can achieve both suppressing the wearer's discomfort when he or she wears the supporting glove, and suppressing the polymer films from being easily peeled off from the knitted glove.

(2)

The method for producing the supporting glove according to (1) above, in which the first polymer mixed liquid is a latex including the first liquid being water, the method further including applying a coagulant solution to the knitted glove before applying the first polymer mixed liquid.

Water included as a dispersion medium (solvent) in the latex is less volatilizable than an organic solvent, and thus tends to remain in the knitted glove after the first polymer mixed liquid application step. Thereby, a capillarity phenomenon easily occurs. When water remaining in the knitted glove is subjected to a capillary phenomenon, the water migrates within the knitted glove along each yarn knitted into the knitted glove. Thus, when the first polymer mixed liquid is a latex, the first polymer included as polymer particles in the latex also migrates along with the migration of water. As a result, when the first polymer mixed liquid is a latex, the first polymer included as the polymer particles in the knitted glove is distributed unevenly through the first polymer mixed liquid application step and the first drying step, making it difficult to form a relatively even polymer film. According to the above configuration, however, the coagulant solution application step of immersing the knitted glove in the coagulant solution is carried out before the first polymer mixed liquid application step; thus, the coagulant solution can coagulate and fix the first polymer at a specific position within the knitted glove. This configuration can suppress the uneven distribution of the first polymer, and can form a relatively even first polymer film.

(3)

The method for producing the supporting glove according to (2) above, in which the coagulant solution to be applied to the knitted glove before applying the first polymer mixed liquid includes 0.01 mass % or more and 0.5 mass % of a salt coagulant.

Conventionally, the coagulation method using a salt coagulant is intended to quickly form a polymer film without causing the polymer mixed liquid to reach the inner surface of the knitted glove in the state of being worn, and thus uses a coagulant solution including the salt coagulant at a relatively high concentration. The above configuration, on the other hand, is employed for the purpose of forming the first polymer film to the inner surface of the knitted glove in the state of being worn by causing the first polymer mixed liquid to reach the inner surface and then be coagulated, and thus uses a coagulant solution including a salt coagulant at an extremely low concentration of 0.01 mass % or more and 0.5 mass % or less. Thus, the coagulant solution can sufficiently permeate into the knitted glove. This configuration can further suppress the uneven distribution of the first polymer within the knitted glove, and can form a more uniform first polymer film within the knitted glove. Since the concentration of the salt coagulant in the coagulant solution applied to the knitted glove before the first polymer mixed liquid application step is as relatively low as 0.01 mass % or more and 0.5 mass % or less, an adverse effect caused by the salt coagulant to the fibers forming each yarn knitted into the knitted glove can be minimized. For example, the fibers can be suppressed from being deteriorated by the salt coagulant.

The method for producing the supporting glove according to the present invention is not limited to the configuration of the aforementioned embodiment. The method for producing the supporting glove according to the present invention is not limited by the aforementioned operation effects, either. Various modifications can be made to the method for producing the supporting glove according to the present invention without departing from the gist of the present invention.

For example, the first polymer mixed liquid, the second coagulant solution, and the second polymer mixed liquid can be applied so that the first polymer film 10B1 and the second polymer film 10B2 are formed on the entire outer surface on the palm side and the back side of the body bag 10*a*.

EXAMPLES

Hereinafter, the present invention will be more specifically described by way of examples. The following examples are provided for more specifically describing the present invention, and do not intend to limit the scope of the present invention.

Supporting gloves according to Examples (Examples 1 to 28 and Comparative Examples 1 to 8) were prepared using materials shown in Table 1 below. The materials shown in Table 1 will be hereinafter described.

<Knitted Glove>

(Nylon)

A wooly nylon yarn having a fineness of 110 dtex (two-ply yarn with each ply having a fineness of 55 dtex) was knitted into a knitted glove by plain knitting (stockinet) using a 21-gauge glove knitting machine (SFG20 manufactured by Shima Seiki Mfg., Ltd). Then, the knitted glove knitted as above was turned inside out to prepare a knitted glove to be processed.

(Polyester)

A wooly polyester yarn having a fineness of 110 dtex (two-ply yarn with each ply having a fineness of 55 dtex) was knitted into a knitted glove by plain knitting (stockinet) using a 21-gauge glove knitting machine (SFG20 manufactured by Shima Seiki Mfg., Ltd). Then, the knitted glove knitted as above was turned inside out to prepare a knitted glove to be processed.

(Liquid Crystal Polyester)

A liquid crystal polyester yarn having a fineness of 110 dtex (Zxion (registered trademark) manufactured by KB SEIREN, LTD.) and an elastic composite yarn were knitted into a knitted glove by plating knitting using a 18-gauge glove knitting machine (SFG-I manufactured by Shima Seiki Mfg., Ltd). The elastic composite yarn was prepared under the conditions of 300 TPM (T/m) and a draft of 2.5, using a spandex yarn having a fineness of 22 dtex as a core yarn and a wooly nylon yarn having a fineness of 44 dtex as a covering yarn. Then, the knitted glove knitted as above was turned inside out to prepare a knitted glove to be processed. A liquid crystal polyester yarn was disposed on the inner surface side of this knitted glove to be processed.

<First Coagulant Solution>

A first coagulant solution was prepared by dissolving 0.1 g of calcium nitrate tetrahydrate in 99.9 g of methanol, that is, prepared so as to have a concentration of calcium nitrate tetrahydrate of 0.1 mass %. Those Examples with blank fields in Table 1 (i.e., Example 5, Example 7, Example 18, Example 26, Example 28, Comparative Examples 1-3, and Comparative Examples 5-8) use no first coagulant solution.

<Second Coagulant Solution>

A second coagulant solution was prepared by dissolving calcium nitrate tetrahydrate in methanol so as to have a concentration shown in Table 1.

<First Polymer Mixed Liquid>

The term "mass parts" of each material hereinafter refers to mass parts of the material as a solid content.

(Acrylonitrile-Butadiene Copolymer (NBR) Latex and Water Mixed Liquid)

100 mass parts of an NBR latex ("Nipol Lx550L" manufactured by Zeon Corporation), 5 mass parts of polycarbodiimide ("XR-5508" manufactured by STAHL Japan K. K.), and 1 mass part of an antioxidant ("Aquanox L" manufactured by Aquaspersions Ltd) were mixed together to obtain a first mixed liquid A, to which water was added to have a concentration of the solid content (NBR particles) included in the NBR latex being the concentration shown in Table 1. An NBR latex and water mixed liquid as the first polymer mixed liquid was thus obtained. In Example 1, for example, water was added to the first mixed liquid to have a concentration of the solid content included in the NBR latex being 0.4 mass %, to obtain the first polymer mixed liquid.

(Polyurethane (PU) Latex and Water Mixed Liquid)

100 mass parts of a PU latex ("HYDRAN (registered trademark) FCS-855" manufactured by DIC Corporation), 5 mass parts of polycarbodiimide ("XR-5508" manufactured by STAHL Japan K. K.), and 1 mass part of an antioxidant ("Aquanox L" manufactured by Aquaspersions Ltd) were mixed together to obtain a first mixed liquid B, to which water was added to have a concentration of the solid content (PU particles) included in the PU latex being the concentration shown in Table 1. A PU latex and water mixed liquid as the first polymer mixed liquid was thus obtained.

(Acrylic Latex and Water Mixed Liquid)

100 mass parts of an acrylic latex, 5 mass parts of polycarbodiimide ("XR-5508" manufactured by STAHL Japan K. K.), and 1 mass part of an antioxidant ("Aquanox L" manufactured by Aquaspersions Ltd) were mixed together to obtain a first mixed liquid C, to which water was added to have a concentration of the solid content (acrylic polymer particles) included in the acrylic latex being the concentration shown in Table 1. An acrylic latex and water mixed liquid as the first polymer mixed liquid was thus obtained. The acrylic latex includes, as the acrylic polymer, a copolymer of n-butylacrylate (nBA), acrylonitrile (AN), and an acrylic acid (AA) (nBA —AN—AA copolymer), and the nBA-AN-AA copolymer was a copolymer including 94 mole % of nBA, 5 mole % of AN, and 1 mole % of AA. The number average molecular weight of the acrylic polymer was about 250,000.

(NBR and MEK Mixed Liquid)

Moisture content was removed from an NBR latex ("Nipol Lx550" manufactured by Zeon Corporation) to obtain NBR particles, and the NBR particles were suspended while being partially dissolved in methyl ethyl ketone (MEK) so that the concentration of the NBR particles was as shown in Table 1.

(NR and n-Hex Mixed Liquid)

Moisture content was removed from a natural rubber (NR) latex ("LATZ" manufactured by Kilang Getah Bukit Perak) to obtain NR particles, and the NR particles were suspended while being partially dissolved in n-hexane (n-Hex) so that the concentration of the NR particles was as shown in Table 1.

Those Examples with blank fields in Table 1 (i.e., Comparative Examples 1-3 and Comparative Examples 5-8) use no first polymer mixed liquid.

<Second Polymer Mixed Polymer>

The term "mass parts" of each material hereinafter refers to mass parts of the material as a solid content. For ammonia water, the term refers to mass parts of the active ingredient in the ammonia water (i.e., ammonia).

(38 Mass % NBR Latex and Water Mixed Liquid (Total Solid Content in the Mixed Liquid of 40 Mass %))

100 mass parts of an NBR latex ("Nipol Lx550L" manufactured by Zeon Corporation), 0.1 mass part of sodium dodecylbenzene sulfonate (manufactured by Kao Corporation), 0.4 mass part of ammonia water (manufactured by Taiseikakou), 0.4 mass part of potassium hydroxide (manufactured by EXCELKOS (M) SDN. BHD.), 0.5 mass part of sulfur (manufactured by EXCELKOS (M) SDN. BHD.), 2 mass parts of zinc oxide (manufactured by EXCELKOS (M) SDN. BHD.), 0.2 mass part of a vulcanization accelerator ("Vulkacite LDA-ZDEC" manufactured by LANXESS), 0.5 mass part of an aging inhibitor ("Vulkanox BKF" manufactured by LANXESS), 2 mass parts of a titanium oxide (manufactured by Huntman), 0.005 mass part of a defoaming agent ("SM-5512" manufactured by Dow Corning Toray Co., Ltd.), and an appropriate amount of thickener ("A-7075" manufactured by Toagosei Company, Limited) were mixed together to obtain a second mixed liquid A, to which water was added to have a concentration of the total solid contents included in the NBR latex being 40 mass % (the concentration of the NBR particles being 38 mass %). As the second polymer mixed liquid, 38 mass % NBR latex and water mixed liquid was obtained. The viscosity of the 38 mass % NBR latex and water mixed liquid as the second polymer mixed liquid was 2050 mPa s, according to the measurement thereof using a Brookfield viscometer under the condition of V6 (i.e., a rotational speed of 6 rpm, a temperature of 25° C.).

(45 Mass % NR Latex and Water Mixed Liquid (Total Solid Contents in the Mixed Liquid of 47 Mass %))

100 mass parts of a natural rubber (NR) latex ("LATZ" manufactured by Kilang Getah Bukit Perak), 2 mass parts of a wax emulsion ("VIVASHIELD 9176" manufactured by H&R WAX (M) SDN. BHD), 0.2 mass part of a potassium hydroxide (manufactured by EXCELKOS (M) SDN. BHD.), 1 mass part of sulfur (manufactured by EXCELKOS (M) SDN. BHD.), 0.2 mass part of a vulcanization accelerator ("Vulkacite LDA-ZDEC" manufactured by LANXESS), 1 mass part of an aging inhibitor ("Vulkanox BKF" manufactured by LANXESS), and an appropriate amount of thickener ("A-7075" manufactured by Toagosei Company, Limited) were mixed together to obtain a second mixed liquid B, to which water was added to have a concentration of the total solid contents included in the NR latex being 47 mass % (the concentration of the NR particles being 45 mass %). As the second polymer mixed liquid, 45 mass % NR latex and water mixed liquid was obtained. The viscosity of the 45 mass % NR latex and water mixed liquid as the second polymer mixed liquid was 2100 mPa s, according to the measurement thereof using a Brookfield viscometer under the condition of V6 (i.e., a rotational speed of 6 rpm, a temperature of 25° C.).

TABLE 1

| | Knitted glove | 1st coagulant solution | 1st polymer mixed liquid | 2nd coagulant solution | 2nd polymer mixed liquid |
|---|---|---|---|---|---|
| Ex. 1 | Nylon | 0.1 mass % calcium nitrate solution | 0.4 mass % NBR latex and water mixed liquid | 0.8 mass % calcium nitrate solution | 38 mass % NBR latex and water mixed liquid |
| Ex. 2 | Nylon | 0.1 mass % calcium nitrate solution | 0.4 mass % NBR latex and water mixed liquid | 1.0 mass % calcium nitrate solution | 38 mass % NBR latex and water mixed liquid |
| Ex. 3 | Nylon | 0.1 mass % calcium nitrate solution | 0.8 mass % NBR latex and water mixed liquid | 0.6 mass % calcium nitrate solution | 38 mass % NBR latex and water mixed liquid |
| Ex. 4 | Nylon | 0.1 mass % calcium nitrate solution | 3.5 mass % NBR latex and water mixed liquid | 0.6 mass % calcium nitrate solution | 38 mass % NBR latex and water mixed liquid |
| Ex. 5 | Nylon | — | 2.0 mass % NBR and MEK mixed liquid | 0.8 mass % calcium nitrate solution | 38 mass % NBR latex and water mixed liquid |
| Ex. 6 | Nylon | 0.1 mass % calcium nitrate solution | 0.4 mass % PU latex and water mixed liquid | 0.4 mass % calcium nitrate solution | 45 mass % NR latex and water mixed liquid |
| Ex. 7 | Nylon | — | 1.0 mass % NR and n-Hex mixed liquid | 0.8 mass % calcium nitrate solution | 45 mass % NR latex and water mixed liquid |
| Ex. 8 | Nylon | 0.1 mass % calcium nitrate solution | 0.4 mass % acrylic latex and water mixed liquid | 0.6 mass % calcium nitrate solution | 38 mass % NBR latex and water mixed liquid |
| Ex. 9 | Nylon | 0.1 mass % calcium nitrate solution | 3.0 mass % acrylic latex and water mixed liquid | 0.6 mass % calcium nitrate solution | 38 mass % NBR latex and water mixed liquid |
| Ex. 10 | Nylon | 0.1 mass % calcium nitrate solution | 0.4 mass % PU latex and water mixed liquid | 0.8 mass % calcium nitrate solution | 38 mass % NBR latex and water mixed liquid |
| Ex. 11 | Nylon | 0.1 mass % calcium nitrate solution | 3.0 mass % PU latex and water mixed liquid | 0.6 mass % calcium nitrate solution | 38 mass % NBR latex and water mixed liquid |
| Ex. 12 | Polyester | 0.1 mass % calcium nitrate solution | 0.4 mass % NBR latex and water mixed liquid | 0.6 mass % calcium nitrate solution | 38 mass % NBR latex and water mixed liquid |
| Ex. 13 | Polyester | 0.1 mass % calcium nitrate solution | 3.0 mass % NBR latex and water mixed liquid | 0.4 mass % calcium nitrate solution | 38 mass % NBR latex and water mixed liquid |
| Ex. 14 | Polyester | 0.1 mass % calcium nitrate solution | 0.4 mass % acrylic latex and water mixed liquid | 0.8 mass % calcium nitrate solution | 38 mass % NBR latex and water mixed liquid |
| Ex. 15 | Polyester | 0.1 mass % calcium nitrate solution | 3.0 mass % acrylic latex and water mixed liquid | 0.2 mass % calcium nitrate solution | 38 mass % NBR latex and water mixed liquid |
| Ex. 16 | Polyester | 0.1 mass % calcium nitrate solution | 0.4 mass % PU latex and water mixed liquid | 0.6 mass % calcium nitrate solution | 38 mass % NBR latex and water mixed liquid |
| Ex. 17 | Polyester | 0.1 mass % calcium nitrate solution | 3.0 mass % PU latex and water mixed liquid | 0.4 mass % calcium nitrate solution | 38 mass % NBR latex and water mixed liquid |
| Ex. 18 | Polyester | — | 3.0 mass % NBR and MEK mixed liquid | 0.6 mass % calcium nitrate solution | 38 mass % NBR latex and water mixed liquid |
| Ex. 19 | Liquid crystal polyester | 0.1 mass % calcium nitrate solution | 0.4 mass % NBR latex and water mixed liquid | 0.8 mass % calcium nitrate solution | 38 mass % NBR latex and water mixed liquid |
| Ex. 20 | Liquid crystal polyester | 0.1 mass % calcium nitrate solution | 0.4 mass % NBR latex and water mixed liquid | 0.6 mass % calcium nitrate solution | 38 mass % NBR latex and water mixed liquid |
| Ex. 21 | Liquid crystal polyester | 0.1 mass % calcium nitrate solution | 3.0 mass % NBR latex and water mixed liquid | 0.6 mass % calcium nitrate solution | 38 mass % NBR latex and water mixed liquid |
| Ex. 22 | Liquid crystal polyester | 0.1 mass % calcium nitrate solution | 0.4 mass % acrylic latex and water mixed liquid | 0.6 mass % calcium nitrate solution | 38 mass % NBR latex and water mixed liquid |
| Ex. 23 | Liquid crystal polyester | 0.1 mass % calcium nitrate solution | 3.0 mass % acrylic latex and water mixed liquid | 0.6 mass % calcium nitrate solution | 38 mass % NBR latex and water mixed liquid |
| Ex. 24 | Liquid crystal polyester | 0.1 mass % calcium nitrate solution | 0.4 mass % PU latex and water mixed liquid | 0.6 mass % calcium nitrate solution | 38 mass % NBR latex and water mixed liquid |
| Ex. 25 | Liquid crystal polyester | 0.1 mass % calcium nitrate solution | 3.0 mass % PU latex and water mixed liquid | 0.6 mass % calcium nitrate solution | 38 mass % NBR latex and water mixed liquid |
| Ex. 26 | Liquid crystal polyester | — | 1.5 mass % NBR and MEK mixed liquid | 0.6 mass % calcium nitrate solution | 38 mass % NBR latex and water mixed liquid |
| Ex. 27 | Nylon | 0.1 mass % calcium nitrate solution | 3.0 mass % acrylic latex and water mixed liquid | 0.4 mass % calcium nitrate solution | 45 mass % NR latex and water mixed liquid |
| Ex. 28 | Polyester | — | 0.4 mass % NBR latex and water mixed liquid | 0.6 mass % calcium nitrate solution | 45 mass % NR latex and water mixed liquid |
| C. Ex. 1 | Nylon | — | — | 0.8 mass % calcium nitrate solution | 38 mass % NBR latex and water mixed liquid |
| C. Ex. 2 | Nylon | — | — | 1.2 mass % calcium nitrate solution | 38 mass % NBR latex and water mixed liquid |
| C. Ex. 3 | Nylon | — | — | 1.7 mass % calcium nitrate solution | 38 mass % NBR latex and water mixed liquid |
| C. Ex. 4 | Nylon | 0.1 mass % calcium nitrate solution | 4.5 mass % NBR latex and water mixed liquid | 0.6 mass % calcium nitrate solution | 38 mass % NBR latex and water mixed liquid |
| C. Ex. 5 | Nylon | — | — | 1.2 mass % calcium nitrate solution | 45 mass % NR latex and water mixed liquid |
| C. Ex. 6 | Nylon | — | — | 1.7 mass % calcium nitrate solution | 45 mass % NR latex and water mixed liquid |
| C. Ex. 7 | Polyester | — | — | 1.7 mass % calcium nitrate solution | 38 mass % NBR latex and water mixed liquid |
| C. Ex. 8 | Liquid crystal polyester | — | — | 1.9 mass % calcium nitrate solution | 38 mass % NBR latex and water mixed liquid |

<Supporting Glove>

The supporting glove according to each of the Examples was prepared as follows, using the knitted glove, the first coagulant solution, the first polymer mixed liquid, the second coagulant solution, and the second polymer mixed liquid, which are shown in Table 1 above.

A knitted glove was placed to cover a metal three-dimensional hand former (hand former for immersion processing), and the knitted glove in this state was heated in an atmosphere at 70° C. Next, the entire outer surface on the palm side of the body bag of the knitted glove, a part of the outer surface on the palm side of the cuff, the entire outer surfaces on the palm side of the first to fifth finger parts, and areas on the back side of the finger parts extending from the fingertip parts to the parts corresponding to the first joints of the fingers of the wearer were immersed in the first coagulant solution from the fingertip side at an angle of 5 to 20° between the surface of the first polymer mixed liquid and a direction in which the third finger part of the knitted glove extends, to apply the first coagulant solution thereto (first coagulant solution application step). Thereafter, the knitted glove was taken out of the first coagulant solution and allowed to dry at 25° C. for 30 seconds to thereby cause methanol to partially volatilize. Then, the knitted glove to which the first coagulant solution had been applied was immersed in the first polymer mixed liquid to apply the first polymer mixed liquid thereto (first polymer mixed liquid application step) in the same manner as described in the first coagulant solution application step. Thereafter, the knitted glove was taken out of the first polymer mixed liquid and allowed to dry at 75° C. for 20 minutes (first drying step). The first polymer film was thus formed on the knitted glove. Next, the knitted glove on which the first polymer film had been formed was adjusted to 60° C. in an oven, and then the knitted glove to which the first polymer film had been formed was immersed in the second coagulant solution to apply the second coagulant solution thereto (second coagulant solution application step) in the same manner as described in the first coagulant solution application step. Thereafter, the knitted glove was taken out of the second coagulant solution and allowed to dry at 25° C. for 30 seconds to thereby cause methanol to partially volatilize. Then, the knitted glove after the second coagulant solution application step was immersed in the second polymer mixed liquid to apply the second polymer mixed liquid thereto (second polymer mixed liquid application step) in the same manner as described in the first coagulant solution application step. Thereafter, the knitted glove was taken out of the second polymer mixed liquid and allowed to dry in an oven at 75° C. for 10 minutes, followed by drying in an oven at 120° C. for 40 minutes (second drying step). The second polymer film was thus formed on the knitted glove. In the first polymer mixed liquid application step, the first polymer mixed liquid was applied to an area slightly smaller than the area to which the first coagulant solution had been applied; in the second coagulant solution application step, the second coagulant solution was applied to an area slightly larger than the area to which the first polymer mixed liquid had been applied; and in the second polymer mixed liquid application step, the second polymer mixed liquid was applied to an area slightly smaller than the area to which the first polymer mixed liquid had been applied, in terms of compensating manufacturing error. Next, after the hand former had been cooled to 25° C., the knitted glove on which the first polymer film and the second polymer film had been formed was pulled out of the hand former to thereby obtain the supporting glove according to each of the Examples. In each of the Examples with blank fields in the column "First coagulant solution" of Table 1, the supporting glove was produced without carrying out the first coagulant solution application step, and in each of the Examples with blank fields in the column "First polymer mixed liquid" of Table 1, the supporting glove was produced without carrying out the first polymer mixed liquid application step and the first drying step.

<Presence of Exposure of Second Polymer Film Through Inner Surface>

The supporting glove according to each of the examples was evaluated as to whether the second polymer film was exposed through the inner surface of the glove (i.e., the surface in contact with the wearer's hand). Whether or not the second polymer film was exposed through the inner surface was evaluated by visual observation. Specifically, the inner surface of the supporting glove according to each of the Examples was visually observed, and was evaluated as "Absent" when the second polymer film did not reach the inner surface, and evaluated as "Present" when the second polymer film was formed to be flush with the inner surface or formed to extend to the outer side of the inner surface (to the side of the wearer's hand). The results are shown in Table 2 below.

<Peel Strength>

The peel strength of the second polymer film of the supporting glove according to each of the Examples was measured. The peel strength of the second polymer film was measured as follows:

(1) Obtain an elongated test specimen having a width of 25 mm and a length of 100 mm from a palm part of the supporting glove according to each of the Examples, so that a length direction of the test specimen coincides with the direction in which the third finger (middle finger) part extends;

(2) Peel a part of the second polymer film from the knitted glove part on one side in the length direction of the test specimen;

(3) Set a distance between two chucks of a tensile tester to 40 mm, have the knitted glove part on the one side of the specimen gripped by one chuck, and have the second polymer film part on the other side of the test specimen gripped by the other chuck;

(4) Obtain a value by averaging a plurality of highest peaks and a plurality of lowest peaks of the testing force (tensile force) observed when 180° peel test is performed at a tensile speed of 50 mm/min and over a traveling distance of 100 mm.

The above measurement was performed for four test specimens. The peel strength was the value obtained by arithmetically averaging the values of the testing force for the four test specimens. The results are shown in Table 2 below.

<Tear Strength>

The tear strength (unit: N) of the supporting glove according to each of the Examples was measured according to EN388. The results are shown in Table 2 below:

<FT-IR Analysis>

Test specimens were obtained from the fingertip part of the third finger (middle finger) part and a central portion of the palm part of the supporting glove according to each of the Examples, and the inner surface side (i.e., the side in contact with the hand of the wearer) of each of these test specimens was analyzed by FT-IR (ATR method). The spectrum data that had been integrated 256 times in the range of 500 to 3500 $cm^{-1}$ was obtained by the FT-IR measurement. The same measurement as above was made for the first polymer films prepared on laboratory dishes as objects for comparison, that is, the NBR film, the NR film, the acrylic polymer film, and the PU film, to obtain the peaks inherent to the first polymer films from the spectrum data. The data of each of the test specimens obtained from the supporting glove according to each of the Examples was compared with the data of each of the first polymer films as the objects for comparison to verify from the major signals (peaks) whether or not the first polymer film was present on the inner surface. The results are shown in Table 2 below. Table 2 below shows the results of the FT-IR analysis for Example 2, Example 5, Example 7, Example 8, Example 10, and Comparative Example 3.

<Dynamic Friction Coefficient>

An elongated test specimen having a width of 6.4 cm and a length of 10 cm was obtained from a central portion of the palm part of the supporting glove according to each of the Examples. The test specimen was obtained so that a length direction of the test specimen coincides with the direction in which the third finger part extends. The dynamic friction coefficient of the test specimen was obtained from the testing force (tensile force) when, according to ASTM D 1894, the obtained test specimen was attached to a friction element having a grounding area of 6.4 cm×6.4 cm and weighing 200 g, and the friction element was dragged on a mirror-finished stainless-steel plate installed horizontally at a speed of 150 mm/min. The above measurement was made for four test specimens. The dynamic friction coefficients obtained for the four test specimens were arithmetically averaged to thereby obtain the average dynamic friction coefficient. The results are shown in Table 2 below. Note that the dynamic friction coefficients in Table 2 refer to the average dynamic friction coefficients as abovementioned.

<Discomfort of Inner Surface>

The supporting glove according to each of the Examples was verified as to whether or not its inner surface brought discomfort to the wearer when his or her hand was in the glove. Whether or not the glove brought discomfort to the wearer was evaluated as "No" when the wearer felt no discomfort at all, evaluated as "Slightly" when the wearer slightly felt discomfort but to the extent that he or she could put up with, and evaluated as "Yes" when the wearer clearly felt discomfort to the extent that he or she could not put up with. The results are shown in Table 2 below. Table 2 shows the major results of the evaluations by five test subjects.

TABLE 2

| | Exposure of second polymer film through inner surface | Peel strength [N] | Tear strength [N] | FT-IR | Dynamic friction coefficient | Discomfort of inner surface |
|---|---|---|---|---|---|---|
| Ex. 1 | Absent | 43.0 | 24.1 | — | 0.35 | No |
| Ex. 2 | Absent | 36.4 | 23.2 | Present | 0.34 | No |
| Ex. 3 | Absent | 25.2 | 23.1 | — | 0.41 | No |
| Ex. 4 | Absent | 21.9 | 22.8 | — | 0.68 | No |
| Ex. 5 | Absent | >43.0 | 23.8 | Present | 0.89 | No |
| Ex. 6 | Absent | 23.3 | 32.4 | — | 0.31 | No |
| Ex. 7 | Absent | 30.1 | 34.5 | Present | 0.93 | No |
| Ex. 8 | Absent | 27.0 | 22.4 | Present | 0.25 | No |
| Ex. 9 | Absent | 29.7 | 22.9 | — | 0.24 | No |
| Ex. 10 | Absent | 25.9 | 23.1 | Present | 0.32 | No |
| Ex. 11 | Absent | 28.1 | 22.5 | — | 0.35 | No |
| Ex. 12 | Absent | 28.1 | 20.2 | — | 0.34 | No |
| Ex. 13 | Absent | 22.3 | 21.3 | — | 0.83 | No |
| Ex. 14 | Absent | 28.6 | 21.1 | — | 0.24 | No |
| Ex. 15 | Absent | 31.2 | 20.7 | — | 0.23 | No |
| Ex. 16 | Absent | 30.2 | 20.8 | — | 0.32 | No |
| Ex. 17 | Absent | 20.2 | 21.5 | — | 0.65 | No |
| Ex. 18 | Absent | 39.6 | 20.1 | — | 2.51 | No |
| Ex. 19 | Absent | 20.3 | 43.0 | — | 0.36 | No |
| Ex. 20 | Absent | 22.2 | 42.5 | — | 0.32 | No |
| Ex. 21 | Absent | 21.0 | 43.8 | — | 0.76 | No |
| Ex. 22 | Absent | 20.8 | 42.1 | — | 0.23 | No |
| Ex. 23 | Absent | 20.1 | 42.8 | — | 0.22 | No |
| Ex. 24 | Absent | 25.3 | 42.3 | — | 0.31 | No |
| Ex. 25 | Absent | 21.0 | 43.7 | — | 0.37 | No |
| Ex. 26 | Absent | 24.9 | 43.5 | — | 2.19 | No |
| Ex. 27 | Absent | 24.3 | 33.8 | — | 0.23 | No |
| Ex.28 | Absent | 25.2 | 24.5 | — | 0.34 | No |
| C. Ex. 1 | Present | 35.8 | 21.1 | — | — | Yes |
| C. Ex. 2 | Present | 22.5 | 17.6 | — | 0.28 | Slightly |
| C. Ex. 3 | Absent | 17.5 | 15.2 | Absent | 0.27 | No |
| C. Ex. 4 | Absent | 16.3 | 22.7 | — | 0.93 | Slightly |
| C. Ex. 5 | Present | 20.0 | 28.1 | — | — | Slightly |
| C. Ex. 6 | Absent | 15.4 | 18.8 | — | 0.27 | No |
| C. Ex. 7 | Absent | 16.0 | 17.2 | — | 0.26 | No |
| C. Ex. 8 | Absent | 12.5 | 40.4 | — | 0.24 | No |

The supporting gloves according to the Examples each had a peel strength of more than 20 N, and were confirmed to have sufficient peel resistance. In contrast, the supporting gloves according to Comparative Examples 3 to 8 each had a peel strength of 20 N or less, and were confirmed not to necessarily have sufficient peel resistance. The supporting gloves according to Comparative Examples 1 and 2 each had a peel strength of more than 20 N, and thus had sufficient peel resistance, but were found to have the second polymer film exposed through the inner surface thereof. Further, the supporting gloves according to the Examples each had a tear strength of more than 20 N, and were confirmed to have sufficient tear resistance.

The IR spectra of the inner surfaces of the supporting gloves according to Examples 2 and 5 included absorption inherent to the IR spectrum of the NBR film as an object for comparison. Similarly, the IR spectra of the inner surfaces of the supporting gloves according to Example 7, Example 8, and Example 10 included absorption inherent to the IR spectra of the NR film, the acrylic polymer film, and the PU film, respectively, as the objects for comparison. In contrast, the IR spectrum of the inner surface of the supporting glove according to Comparative Example 3 did not include absorption inherent to the IR spectrum of any of the NBR film, the NR film, the acrylic polymer film, and the PU film. It is confirmed from these results that the first polymer film had been formed on the inner surface of the supporting glove according to each of Examples 2, 5, 7, 8, and 10.

Further, the supporting glove according to each of Examples 1 to 7, 10, and 11 had a dynamic friction coefficient value that was higher than the dynamic friction coefficient value of the supporting glove according to Comparative Example 3, while the supporting glove according to each of Examples 8, 9, and 27 had a dynamic friction coefficient value that was lower than the dynamic friction coefficient value of the supporting glove according to Comparative Example 3. The supporting glove according to each of Examples 12, 13, and 16 to 18 had a dynamic friction coefficient value that was higher than the dynamic friction coefficient value of the supporting glove according to Comparative Example 7, while the supporting glove according to each of Examples 14 and 15 had a dynamic friction coefficient value that was lower than the dynamic friction coefficient value of the supporting glove according to Comparative Example 7. The supporting glove according to each of Examples 19 to 21 and 24 to 26 had a dynamic friction coefficient value that was higher than the dynamic friction coefficient value of the supporting glove according to Comparative Example 8, while the supporting glove according to each of Examples 22 and 23 had a dynamic friction coefficient value that was lower than the dynamic friction coefficient value of the supporting glove according to Comparative Example 8. It is understood from the above that the inner surface of the supporting glove has an increased gripping force and becomes less slippery to increase the workability with the supporting glove when the first polymer film is formed of any of the NBR film, the NR film, and the PU film, and that the supporting glove achieves an increased wearing and removing performance when the first polymer film is formed of the acrylic polymer film.

The supporting glove according to each of the Examples had its inner surface evaluated for the discomfort as "No", and thus could suppress the wearer's discomfort when his or her hand was in the supporting glove.

REFERENCE SIGNS LIST

1: Supporting glove
10: Glove body
20: Cuff
10A: Knitted glove
10B: Polymer film
10B1: First polymer film
10B2: Second polymer film

The invention claimed is:

1. A method for producing a supporting glove, the method comprising the steps of:

applying a first polymer mixed liquid comprising a first liquid and a first polymer, the first polymer mixed liquid comprising 0.2 mass % or more and 4.0 mass % or less of the first polymer, to at least a part of a knitted glove formed by knitting a yarn having a fineness of 33 dtex or more and 180 dtex or less;

drying the first polymer mixed liquid applied to the knitted glove;

applying a coagulant solution to the knitted glove after drying the first polymer mixed liquid;

applying a second polymer mixed liquid comprising a second liquid and a second polymer, the second polymer mixed liquid comprising 20 mass % or more and 65 mass % or less of the second polymer, to at least a part of an area of the knitted glove after applying the coagulant solution, the area having the first polymer mixed liquid applied thereto; and drying the second polymer mixed liquid applied to the knitted glove, wherein applying the first polymer mixed liquid and drying the first polymer mixed liquid are carried out to form a first polymer film so as to cover the yarn knitted into the knitted glove over the entire thickness direction of at least the part of the knitted glove, and applying the coagulant solution, applying the second polymer mixed liquid, and drying the second polymer mixed liquid are carried out to form a second polymer film so as to form at least a part of an outer surface of the knitted glove in a state of being worn, and carried out to form the second polymer film so as to continuously cover the first polymer film from the outer surface toward but not reaching an inner surface of the knitted glove in a state of being worn.

2. The method for producing the supporting glove according to claim 1, wherein the first polymer mixed liquid is a latex comprising the first liquid being water, the method further comprising applying a coagulant solution to the knitted glove before applying the first polymer mixed liquid.

3. The method for producing the supporting glove according to claim 2, wherein the coagulant solution to be applied to the knitted glove before applying the first polymer mixed liquid comprises 0.01 mass % or more and 0.5 mass % of a salt coagulant.

* * * * *